US005406317A

United States Patent [19]

Shimamura et al.

[11] Patent Number: 5,406,317

[45] Date of Patent: Apr. 11, 1995

[54] INK JET RECORDING WITH COORDINATED CAPPING AND RECOVERY EJECTION OPERATIONS

[75] Inventors: Yoshiyuki Shimamura, Yokohama; Kazuya Iwata, Kawasaki; Jun Katayanagi, Musashino, all of Japan

[73] Assignee: Canon Kabushiki Kaisha, Tokyo, Japan

[21] Appl. No.: 925,218

[22] Filed: Aug. 6, 1992

Related U.S. Application Data

[62] Division of Ser. No. 654,199, Feb. 12, 1991, Pat. No. 5,170,186.

[30] Foreign Application Priority Data

Feb. 13, 1990 [JP] Japan ..... 2-31694
Feb. 13, 1990 [JP] Japan ..... 2-31698
Feb. 13, 1990 [JP] Japan ..... 2-31711

[51] Int. Cl.[6] ..... B41J 2/165
[52] U.S. Cl. ..... 347/23; 347/29
[58] Field of Search ..... 346/140, 75; 347/23, 347/29, 35

[56] References Cited

U.S. PATENT DOCUMENTS 3,925,788 12/1975 Kashio ..... 346/75
3,925,789 2/1975 Kashio ..... 346/75
4,577,203 3/1986 Kawamura ..... 346/140 R
4,739,340 4/1988 Terasawa ..... 346/1.1
4,819,012 4/1989 Kiyohara et al. ..... 346/140 R
4,967,204 10/1990 Terasawa et al. ..... 346/1.1
5,109,233 4/1992 Nishikawa ..... 346/140 X

FOREIGN PATENT DOCUMENTS 3633239 4/1987 Germany ..... B41J 3/04
62-077940 4/1987 Japan ..... B41J 3/04
62-077941 4/1987 Japan ..... B41J 3/04
2218380 11/1989 United Kingdom .

OTHER PUBLICATIONS

British Patent Office Official Action in Application No. GB 9103003.1, May 11, 1993.
British Patent Office Official Action in Application No. GB 9103003.1, Feb. 7, 1994.

*Primary Examiner*—Joseph W. Hartary
*Attorney, Agent, or Firm*—Fitzpatrick, Cella, Harper & Scinto

[57] ABSTRACT

A recording apparatus for performing recording with an ink jet recording head, capable of ejecting ink onto a recording medium, comprises a cap to be opened and closed with respect to a discharge-orifice face of the recording head and a cap drive mechanism for opening the cap at the initiation of recording head driving and closing the cap when a non-driving period of the recording head exceeds a predetermined period of time $\alpha$. A preliminary ejection circuit causes ejection of ink from the discharge orifices by driving the recording head to remedy defective ink ejection and preliminary ejection drive circuitry provides for preliminary ejection when a predetermined period of time $\beta$ is exceeded after a previously executed preliminary ejection, wherein the predetermined period of time $\beta$ does not include time during which the cap is closed.

28 Claims, 29 Drawing Sheets

| FIG. 29A | FIG. 29B |
|---|---|

INK JET RECORDING WITH COORDINATED CAPPING AND RECOVERY EJECTION OPERATIONS

This application is a division of application Ser. No. 07/654,199 filed Feb. 12, 1991, now U.S. Pat. No. 5,170,186.

BACKGROUND OF THE INVENTION

1. Field of the Invention

This invention relates to a recording apparatus for performing recording with an ink jet recording head.

2. Related Background Art

There are various recording apparatuses, which perform recording on recording media such as paper and OHP sheet (hereinafter referred to as recording paper or merely paper). These recording apparatuses use a recording head mounted on them. The recording head used is of various systems such as wire dot system, heat-sensitive system, heat transfer system and ink jet system.

Among these recording systems, the ink jet system is one, in which ink is ejected directly toward recording paper. Therefore, its running cost is inexpensive, and it is noted as a quiet recording system.

The recording system based on the ink jet system generally uses a recording head having an array of fine ink discharging orifices. Therefore, when it is desired to operate the recording head for long time, capping is done in order to prevent intrusion of air bubbles and dust inwards from discharging orifices or to prevent ink from becoming defectively ejectable and unsuited for recording due to increase of its viscosity resulting from evaporation of its solvent. The capping is done as follows. A cap is provided, which can cover an orifice-formed face of recording head. The orifice-formed face is covered by the cap when the recording head is not used.

However, in case when a state of defective ejection as noted above is produced in spite of the capping or when discharging orifices not or less used according to a print pattern become defectively electable during recording operation, it is effective to flush the ink for removing the cause of such defective ejection (the process being referred to as ejection recovering process).

In one form of a means for carrying out such ejection recovering process, ink ejection energy generators provided inside the discharting orifices of the recording head are driven to cause ejection of ink from all the discharging orifices toward the cap used for the capping noted above (the ejection being hereinafter referred to as preliminary ejection). This is done for the purpose of removing the cause of defective ejection together with ink. An ink absorbing member is provided inside the cap opposing the discharging orifices for preventing leakage or spattering of ink coming out from the discharging orifices at the time of preliminary ejection.

Further, a pump is provided in communication with and to provide an absorbing force to the cap. The pump serves to absorb ink remaining in the cap after preliminary ejection toward it (the absorption being hereinafter referred to as dry absorption), thus preventing deterioration of ink absorption capacity or reduction of ink absorbing force due to solidification of ink within the absorbing member.

To carry out the dry absorption as noted above, a time for restoring the recording head to the capping position and also a time for operating the pump are necessary, and the timing for effecting dry absorption is important for improving the speed of recording.

In the prior art ink jet recording apparatus, the time for restoring the recording head is reduced by carrying out the dry absorption in an interlocked relation to the capping. The capping is effected in case when the recording head is not operated for long time, for instance in such case as when recording is interrupted for no recording data is transferred for a predetermined period of time during recording operation or when recording is interrupted after the end of recording of one page. This means that dry absorption is carried out before capping.

Since in the prior art ink jet recording apparatus the dry absorption is carried out in an interlocked relation to the capping, there are cases when the dry absorption is unnecessarily executed many times. For example, it is executed even in the absence of recording data transferred for a predetermined period of time during recording.

The ink receiving capacity of the cap varies depending on the volume thereof or on the ink absorbing member, but it is such that ink elected in plurality of times of preliminary ejection can be received. Therefore, carrying out preliminary ejection in spite of sufficiently redundant ink receiving capacity leads to increasing the number of times of dry absorption and also the recording period.

Since the preliminary ejection requires time for restoring the recording head to the capping position and also time for driving the head as noted above, for reducing the recording time it is necessary to reduce the number of times of preliminary ejection. In the prior art recording apparatus, preliminary ejection is carried out periodically lest defective ejection of ink from the head should result during recording as well. More specifically, time elapsed after the previous preliminary ejection is measured, and preliminary ejection is caused whenever a predetermined period of time is passed.

In practice, when recording operation is interrupted and capping is executed, and timer is cleared, the cap is opened, and time measurement is effected once again when resuming the recording operation. This means that when the recording head is held capped for long time or when capping operation is caused frequently in the predetermined period of time noted above, preliminary ejection is not effected before defective ejection results.

Further, where preliminary ejection is done whenever the cap is opened, the number of times of preliminary ejection is increased, although defective ejection will not result.

As shown, with the prior art ink jet recording apparatus the timing of preliminary ejection is determined without considering the period of capping. Therefore, there are problems of occurrence of defective ejection of the recording head and increase of number of times of preliminary ejection.

SUMMARY OF THE INVENTION

An object of the invention is to provide a recording apparatus, in which ejection recovering process executed with respect to an ink jet recording head is improved.

Another object of the invention is to provide a recording apparatus, in which the ink jet recording head never becomes defectively ejectable, thus ensuring stable recording.

A further object of the invention is to provide a recording apparatus, in which the ejection recovering process executed with respect to the ink jet recording head is improved, and which permits reducing the number of times of dry absorption executed during recording as well as recording time.

A yet further object of the invention is to provide a recording apparatus, which permits reducing the number of times of preliminary ejection without possibility of making the ink jet recording head defectively ejectable.

To attain the above objects of the invention, there is provided a recording apparatus for performing recording with an ink jet recording head capable of ejecting ink onto a recording medium for at least one page comprising:

an ink receiving section disposed at a position to be able to oppose an orifice-formed face of said recording head;

preliminary ejection means for causing ink ejection from discharging orifices toward said ink receiving section by driving said recording head to remove causes of defective ink ejection;

dry absorption means for absorbing ink remaining in said ink receiving section as a result of ink ejection by said preliminary ejection means; and first dry absorption control means for causing ink absorption by driving said dry absorption means when the number of times of ejection by said preliminary ejection means exceeds a predetermined number n1 after absorption previously executed by said dry absorption means during recording on said recording medium by said recording head.

To the same end, there is also provided a recording apparatus for performing recording with an ink jet recording head capable of electing ink onto a recording medium for at least one page comprising:

an ink receiving section disposed at a position to be able to oppose an orifice-formed face of said recording head;

preliminary ejection means for causing ink ejection toward said ink receiving section from discharging orifices by driving said recording head to remove causes of defective ink ejection;

dry absorption means for absorbing ink remaining in said ink receiving section as a result of ink ejection by said preliminary ejection means; and dry absorption control means for causing absorption by driving said dry absorption means whenever recording of one page on said recording medium by said recording head is ended.

To the same end, there is further provided a recording apparatus for performing recording with an ink jet recording head capable of ejecting ink onto a recording medium for at at least one page comprising:

a cap formed such as to be opened and closed with respect to an orifice-formed face of said recording head and thus be able to cover said orifice-formed surface;

cap drive means for opening said cap at the start of driving said recording head and closing said cap when a non-driving period of said recording head exceeds a predetermined period $\beta$ of time;

preliminary ejection means for causing ejection of ink from discharging orifices by driving said recording head for removing causes of defective ink ejection;

preliminary ejection drive means for driving said preliminary ejection means when a predetermined period of time is exceeded after ejection executed previously by said preliminary ejection means; and preliminary ejection drive control means for controlling the time interval of closure of said cap driven by said cap drive means such that said predetermined period $\beta$ of time is not included.

DETAILED DESCRIPTION OF THE PREFERRED EMBODIMENTS

Now, an embodiment of ink jet recording apparatus according to the invention will be described with reference to the drawings.

Figure 1A:
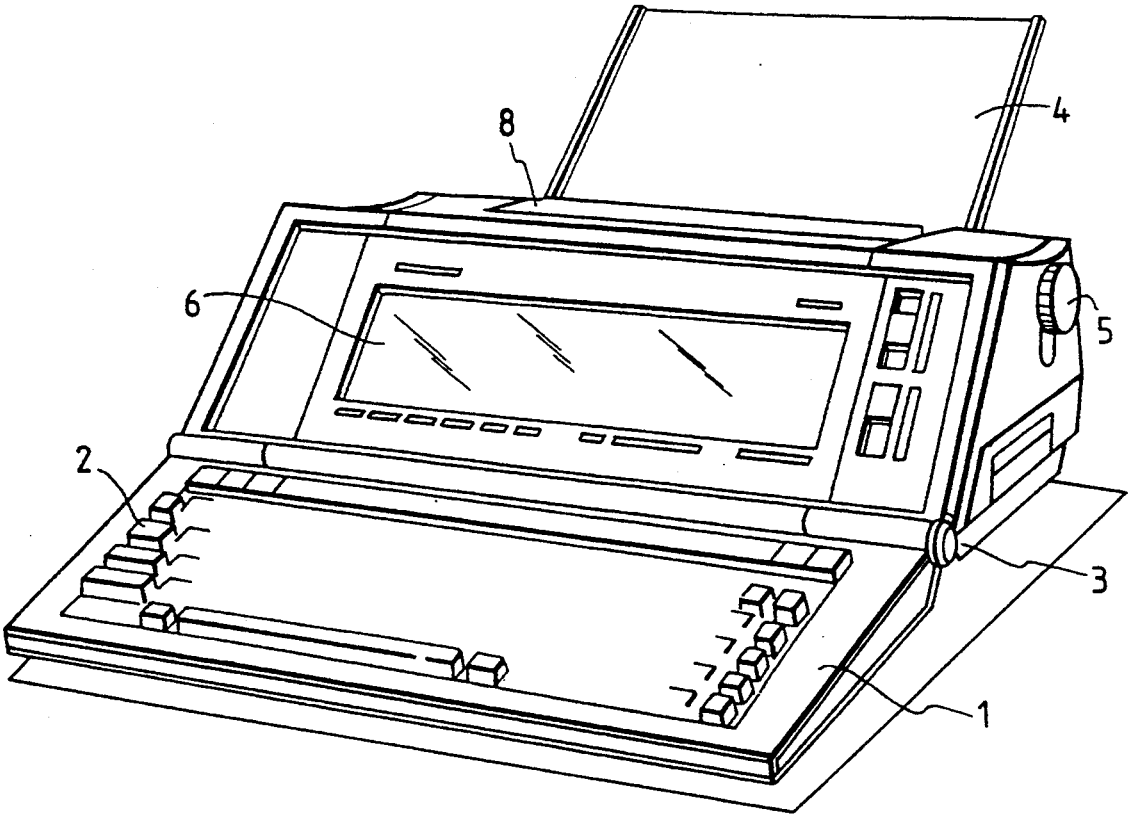
FIGS. 1A and 1B are perspective views showing an embodiment of the invention applied to a document processing system, in use and in storage, respectively.
Figure 1B:
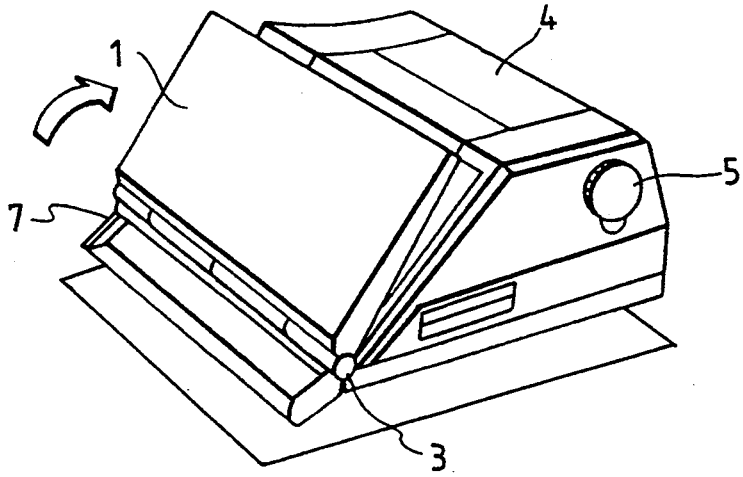

FIGS. 1A and 1B show an example of the construction of the embodiment of the invention applied to a document processing system.

Referring to the Figures, designated at 1 is a key board unit. Unit 2 has keys for inputting characters and numerical Figures and also control keys, these keys being arranged in key array 2, and when it is not used it can be folded about hinge 3 to a state as shown in FIG. 1B. Designated at 4 is a feed tray for feeding sheet-like recording medium into printer unit 8 provided inside the apparatus. When key board unit 1 is folded after use, it covers printer unit 8 as shown in FIG. 1B. Designated at 5 is a feed knob for manually setting and discharging recording medium, at 6 is a display for displaying input document or the like, and at 7 is a grip which may be used when transporting the apparatus in this embodiment.

Figure 2:
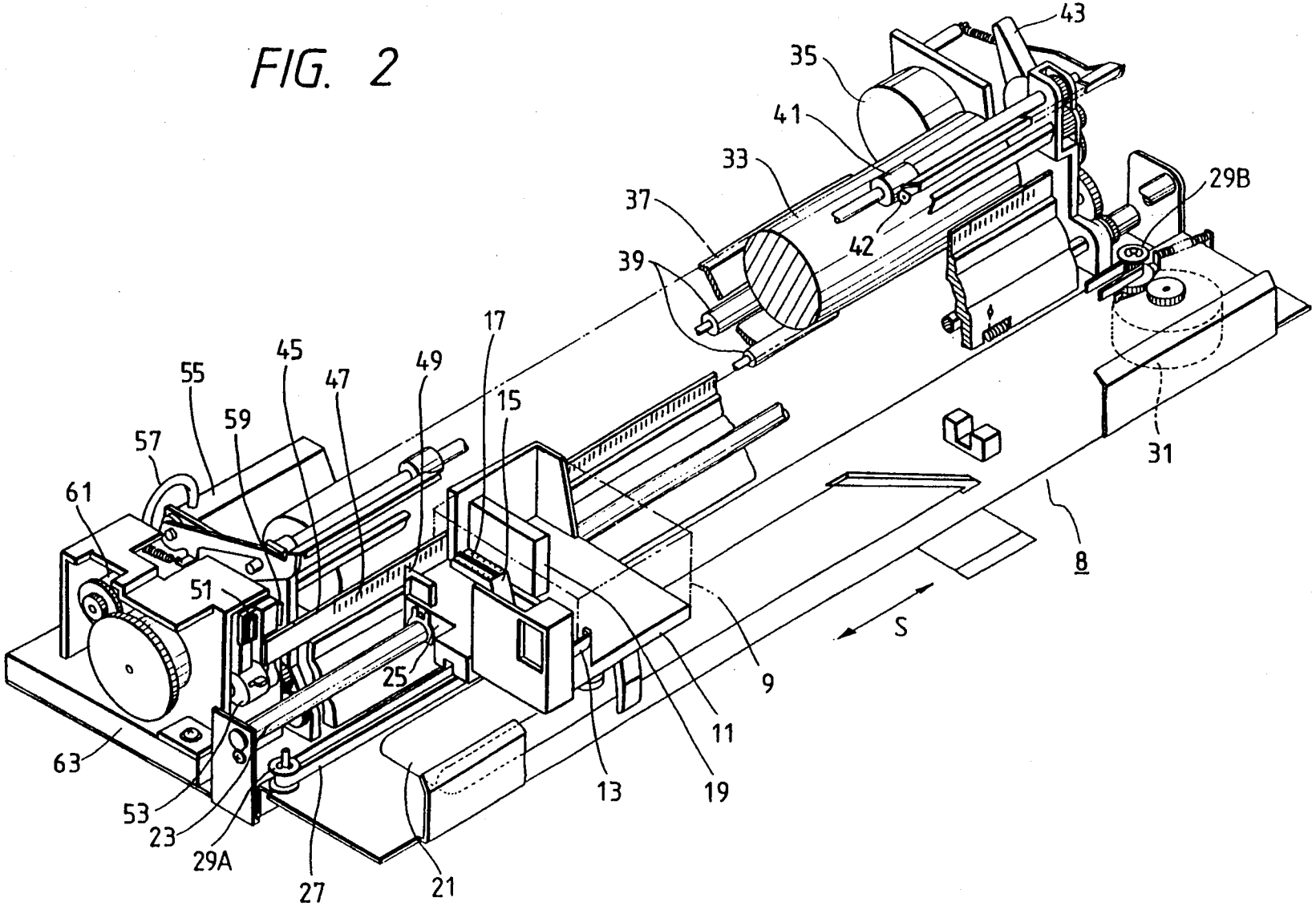
FIG. 2 is a perspective view showing an example of printer capable of use according to the invention.

FIG. 2 shows an example of construction of printer unit 8 in this embodiment.

Referring to the Figure, designated at 9 is a head cartridge having an ink jet recording head as will be described later in detail with reference to FIGS. 3 and 4, and at 11 a carriage carrying the cartridge and scanning in directions S. Designated at 13 is a hook for mounting head cartridge 9 on carriage 11, and at 15 is a lever for operating hook 13. Lever 15 has marker 17, which can mark a scale provided on a cover to be described later to permit reading of printing position, set position, etc. occupied by the recording head of the head cartridge. Designated at 19 is a support plate supporting an electric connection section with respect to head cartridge 9. Designated at 21 is a flexible cable for connecting the electric connection section and control unit of the machine body.

Designated at 23 is a guide shaft for guiding carriage 11 in directions S. The guide shaft penetrates bearing 25 of carriage 11. Designated at 27 is a timing belt, to which carriage 11 is secured, and which transmits power for moving carriage 11 in directions S. The timing belt is passed round pulleys 29A and 29B provided on opposite sides of the apparatus. Drive force is transmitted to one of pulleys, i.e., pulley 29B, from carriage motor 31 via a transmitting mechanism including gears.

Designated at 33 is a platen roller for regulating the recording surface of paper or like recording medium (hereinafter referred to as recording paper) and feeding recording paper when recording or like is performed. Designated at 37 is a paper pan for leading recording medium from feed tray 4 to a recording position, and at 39 is a feed roller, which feeds recording medium by urging the medium against platen roller 33. Designated at 41 is a discharging roller, which is provided ahead of the recording position of recording medium in the feeding direction thereof for discharging the medium toward a discharging opening (not shown). Designated at 42 is a roller facing discharging roller 41 and serving to urge roller 41 via recording medium to produce a force, with which the recording medium is fed by discharging roller 41. Designated at 43 is a release lever for releasing the bias of feed roller 39, keep plate 45 and roller 42 when setting recording medium or in like case.

Designated at 45 is keep plate disposed in the neighborhood of the recording position and serving to suppress floating-up of recording medium and ensure close contact state thereof with platen roller 33. In this embodiment, an ink jet recording head is used, which can jet ink for recording. Therefore, the distance between the orifice-formed face of the recording head and recording surface of the recording medium has to be comparatively small and controlled stringently to avoid contact between the recording medium and orifice-formed face. To this end, disposition of keep plate 45 is effective. Designated at 47 is a scale provided on keep plate 45. Carriage 11 is provided with marker 49 which opposes scale 47. This arrangement also permits reading of the printing position and set position of the recording head.

Designated at 51 is a cap, which is made of an elastic material such as rubber and faces the orifice-formed face of the recording head in its home position. The cap is supported such that it can brought into contact with and separated from the recording head. It can be used for protection of the head in a non-recording period or when carrying out an operation of jetting recovering of the head. By the term "operation of jetting recovering" is meant a process of causing ink to be jet from all the discharging orifices by driving energy generating elements disposed inside the orifices and utilized for ink jetting, thereby removing causes of defective jetting such as introduced air bubbles and dust and ink with increased viscosity and no longer suited for recording, or a process of forced discharging of ink from the discharging orifices executed independently of the first-mentioned process for removal of causes of defective jetting.

Designated at 53 is a pump, which provides an absorbing force for forced discharging of ink and is used for absorbing ink received in cap 51 in a jetting recoverying process through such forced discharging or through preliminary jetting. Designated at 55 is an waste ink tank for storing waste ink absorbed by pump 53, and at 57 is a tube communicating pump 53 and waste ink tank 55 with each other.

Designated at 59 is a blade for performing wiping of the orifice-formed face of the recording head. The blade is supported for movement between a position to project to the recording head side to effect wiping during movement of the head and a retracted position out of engagement with the orifice-formed face of the recording head. Designated at 61 is a recovering system motor, and at 63 is a cam unit for effecting the driving of pump 53 and movement of cap 51 and plate 59 by receiving force transmitted from recovering system motor 61.

Head cartridge 9 noted above will now be described in detail.

Figure 3:
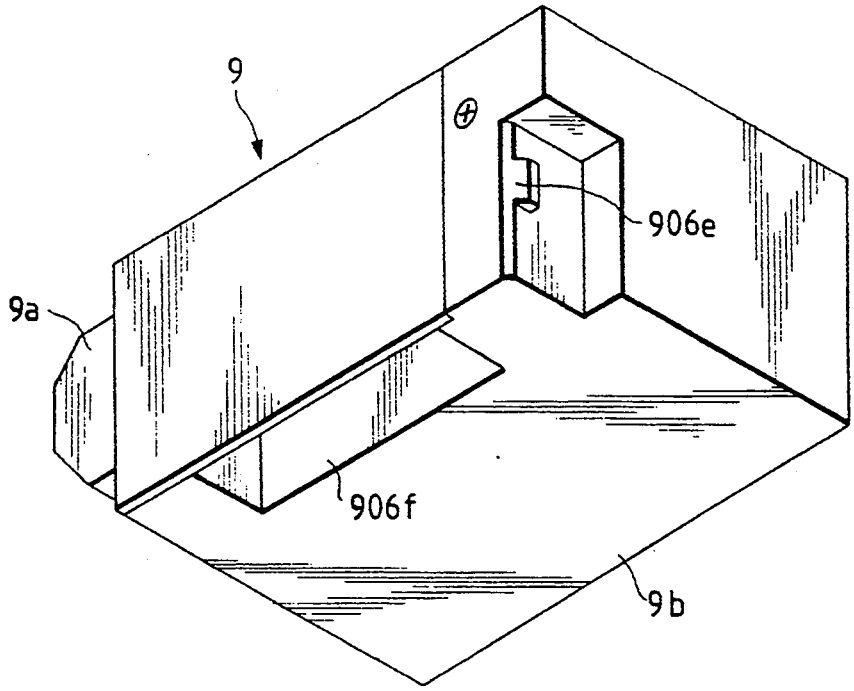
FIG. 3 is a perspective view showing a head cartridge shown in FIG. 2.

FIG. 3 is a perspective view showing head cartridge 9 constituting an ink jet recording head body and integrally including ink jet unit **9*a* and ink tank 9*b*. Referring to the Figure, designated at 906*e* is a pawl which is locked by hook 13 provided on carriage 11 when mounting head cartridge 9. As is clearly shown, pawl 906*e* is disposed on the inner side of the extension of the recording head. Further, a striker (not shown) for positioning is provided on head cartridge 9 in the neighborhood of forward jet unit 9*a*. Designated at 906*f* is a head recess, into which is inserted a support plate erected from carriage 11** and supporting a flexible circuit board (i.e., electric connection section) and rubber pad.

Figure 4B:
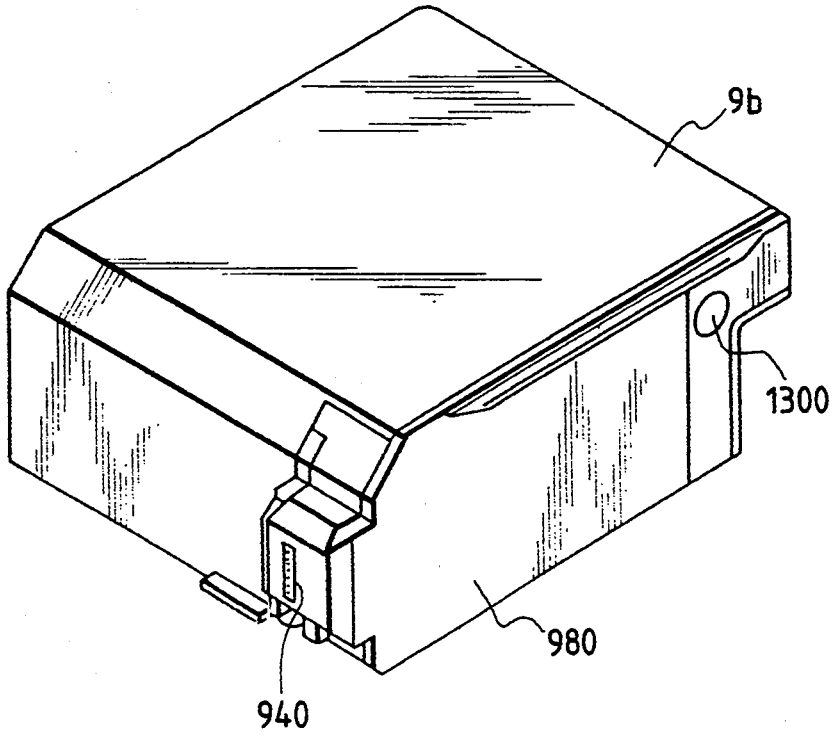
FIGS. 4A and 4B are an exploded perspective view and a perspective view, respectively, showing the head cartridge shown in FIG. 3.
Figure 4A:
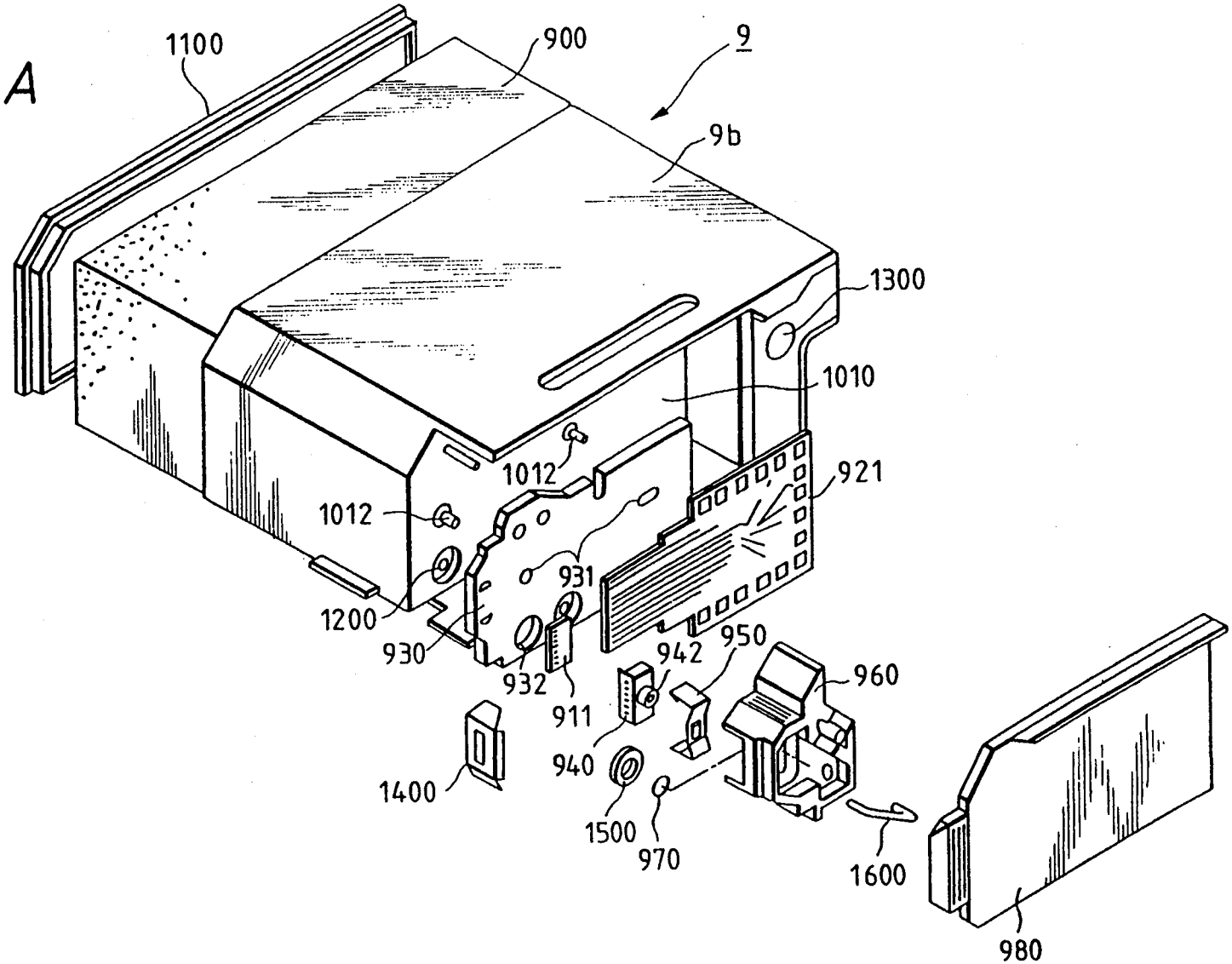

FIGS. 4A and 4B are perspective views showing the head cartridge shown in FIG. 3. As noted above, the head cartridge is of a disposable type integrally including an ink source and an ink accommodating section.

Referring to FIG. 4A, designated at 911 is a heater board including an electricity-heat converter (i.e., jetting heater) and lead of aluminum or like material for supplying power to the element, the element and lead being formed by thin film techniques on a silicon substrate. Designated at 921 is a wiring board corresponding to heater board 911, with corresponding leads connected to one another by wire bonding, for instance.

Designated at 940 is a ceiling plate provided with partitioning walls defining ink paths and a common ink chamber. In this embodiment, the ceiling plate is made of a resin material and integrally includes an orifice plate portion.

Designated at 930 is a support member made of a metal, for instance, and at 950 is a retainer spring. Heater board 911 and ceiling plate 940 are engaged with each other in a state sandwiched between support member 930 and retainer spring 950, and they are urgedly secured to each other by the biasing force of retainer spring 950. Support member 930 may include wiring board 921 provided by bonding or the like and have a reference of positioning with respect to carriage 11 for head scanning. Further, it may function as well as heat radiating member to radiate heat produced in heater board 911 by driving and thus cooling the board.

Designated 960 is a supply tank, which is supplied with ink from ink reservior **9*b* constituting the ink source and leads the supplied ink to common ink chamber defined by the bonding between heater board 911 and ceiling plate 940. Designated at 970 is a filter disposed in supply tank 960 and near an ink supply port leading to the common ink chamber, and at 980 a lid member covering the supply tank 960**.

Designated at 900 is an absorbing member for being impregnated with ink. This member is disposed in ink tank body **9*b*. Designated at at 1200 is a supply port, through which ink is supplied to recording element 9*a* consisting of elements 911 to 980. Absorbing member 900 may be impregnated with ink by injecting ink from supply port 1200 in a step prior to disposing the unit in part 1010 of ink tank body 9*b***.

Designated at 1100 is a lid member of the cartridge body, and at 140 is an atmosphere communication port provided in the lid member for communicating the cartridge interior to atmosphere. Designated at 1300 is a repelling member disposed inside atmosphere communication port 1400 to prevent leakage of ink from atmosphere communication port 1400.

After charging of ink into ink tank **9*b* through supply port 1200 has been completed, jetting unit 9*a* consisting of parts 911 to 980 is disposed in part 1010. The positioning or securing at this time can be done by engaging projection 1012 of ink tank body 9*b* and corresponding hole 931 in support memer 930, and by so doing head cartridge 9** shown in FIG. 4B is completed.

Ink is supplied from the cartridge inside through supply port 1200, hole 932 formed in support plate 930 and an inlet port provided on the back side of supply tank 960 shown in FIG. 4A into supply tank 960, and thence it flows through an outlet port, a suitably provided supply ductline and ink inlet 942 of ceiling plate 940 into the common ink chamber. In the above ink path, connecting sections are provided with packings of, for instance, silicone rubber, butyl rubber and so forth to provide sealing and ensuring the ink supply path.

A mounting/dismounting operation mechanism is constituted by operating lever 15, hook 13 and other members. It is provided on the side of carriage 11, i.e., on the moving direction side thereof, and therefore it will never define a great dead space with movement of the carriage.

Now, the striker for positioning when mounting the head cartridge will be described.

Designated at **601*a* are striking portions for positioning in transversal directions. They are provided at two side positions of striker 607. In addition to striking portions 601*a* further striking portion 601*f*** which is provided on the support plate is utilized for positioning in transversal directions.

Designated at **601*b* are striking portions for positioning in longitudinal or back-and-forth directions. These portions are formed in side lower portions of striker 607**.

Designated at **601*c* are striking portions for positioning in vertical directions. These portions are formed at two positions, i.e., on a side lower portion of striker 607** and a side lower portion of the support plate.

Figure 5A:
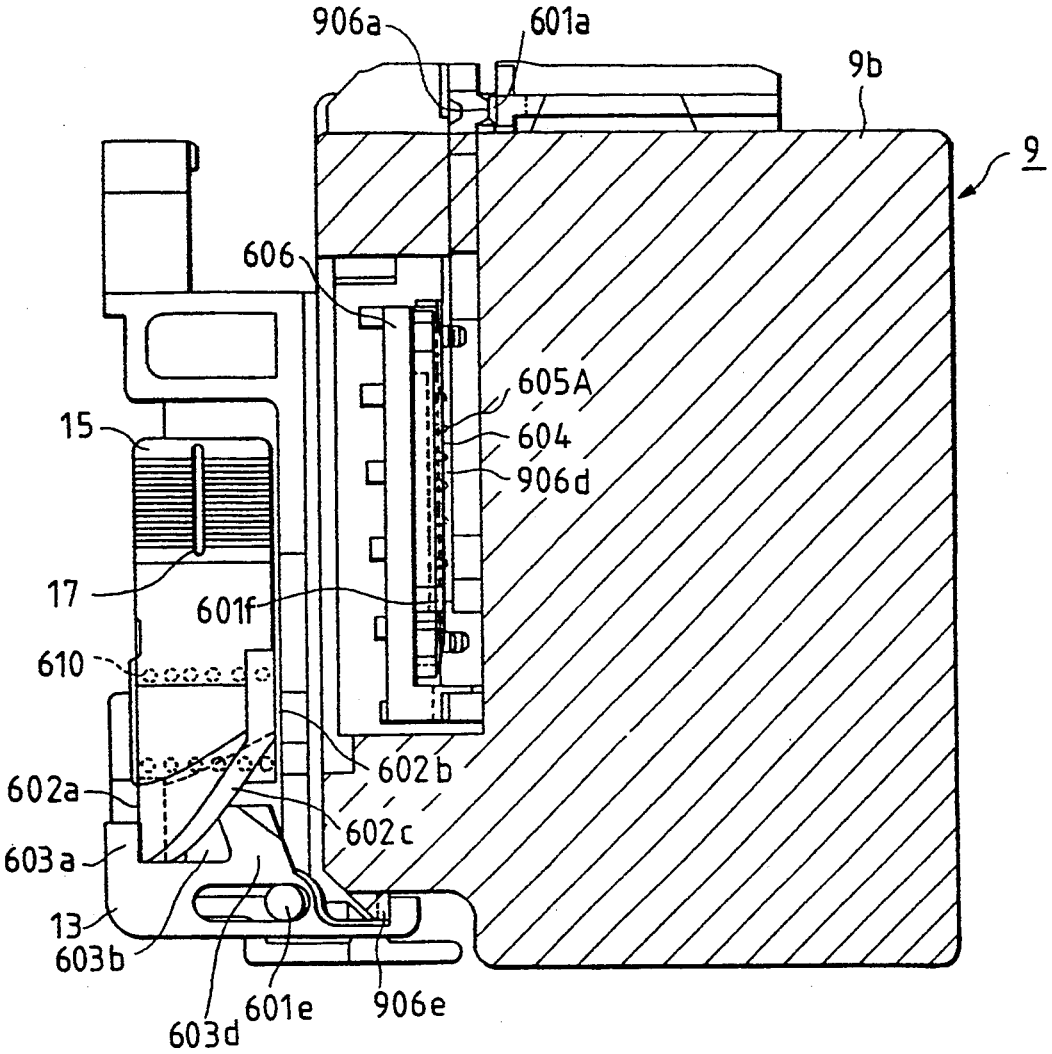
FIGS. 5A and 5B are a top view and a side view, respectively, showing the same head cartridge mounted on a carriage.
Figure 5B:
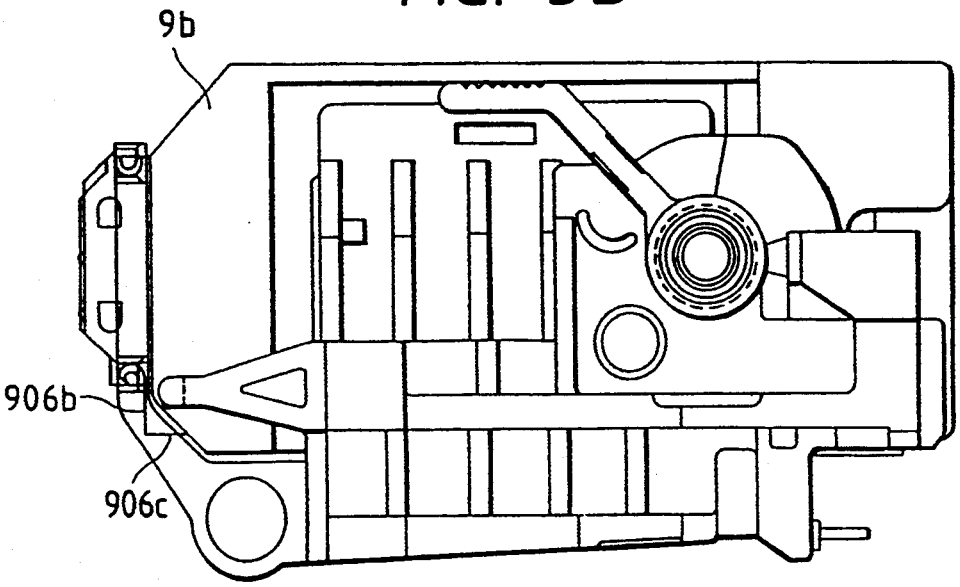

FIGS. 5A and 5B are a top view and a left side view, respectively, showing carriage 11 and head cartridge 9 mounted thereon.

Referring to these Figures, designated at **906*a* is an engagement portion provided on head cartridge 9 such as to be able to engage striking portions of carriage 11 when mounting the recording head, and at 906*b* and 906*c* are engagement portions similarly corresponding to respective striking portions 601*b* and 601*c***.

Now, coupling relation of various parts when the recording head is mounted will be described with reference to FIG. 5A.

Engaging portion **906*a* of head cartridge 9 is in engagement with striking portion 601*a* of carrier 6, and at the same time pawl 906 of head cartridge 9 receives a leftward force in the Figure due to a biasing force of coil spring 610 via hook 13 locked by it. Head cartridge 9 thus receives a moment about the engagement portion noted above. At this time, board 906*a* provided on the head is brought into engagement with striking portion 601*f*, and thus head cartridge 9** is positioned in transversal directions and is held at that position.

At this time, projection 605A of rubber pad 605 is compressed and deformed as it engages with board **906*d*. This deformation produces a force to have a terminal pad of flexible substrate 604 and terminal of substrate 906*d* in forced contact with each other. At this time, striking portion 601*f* is in contact with board 906*d*, and thus projection 605A** is deformed to a constant extent, thus obtaining the urging force noted above stably.

There is no showing of a compressedly deformed state of projection 605A.

The positioning of head cartridge 9 in back-and-forth and vertical directions is done while the recording head is mounted.

Figure 6:
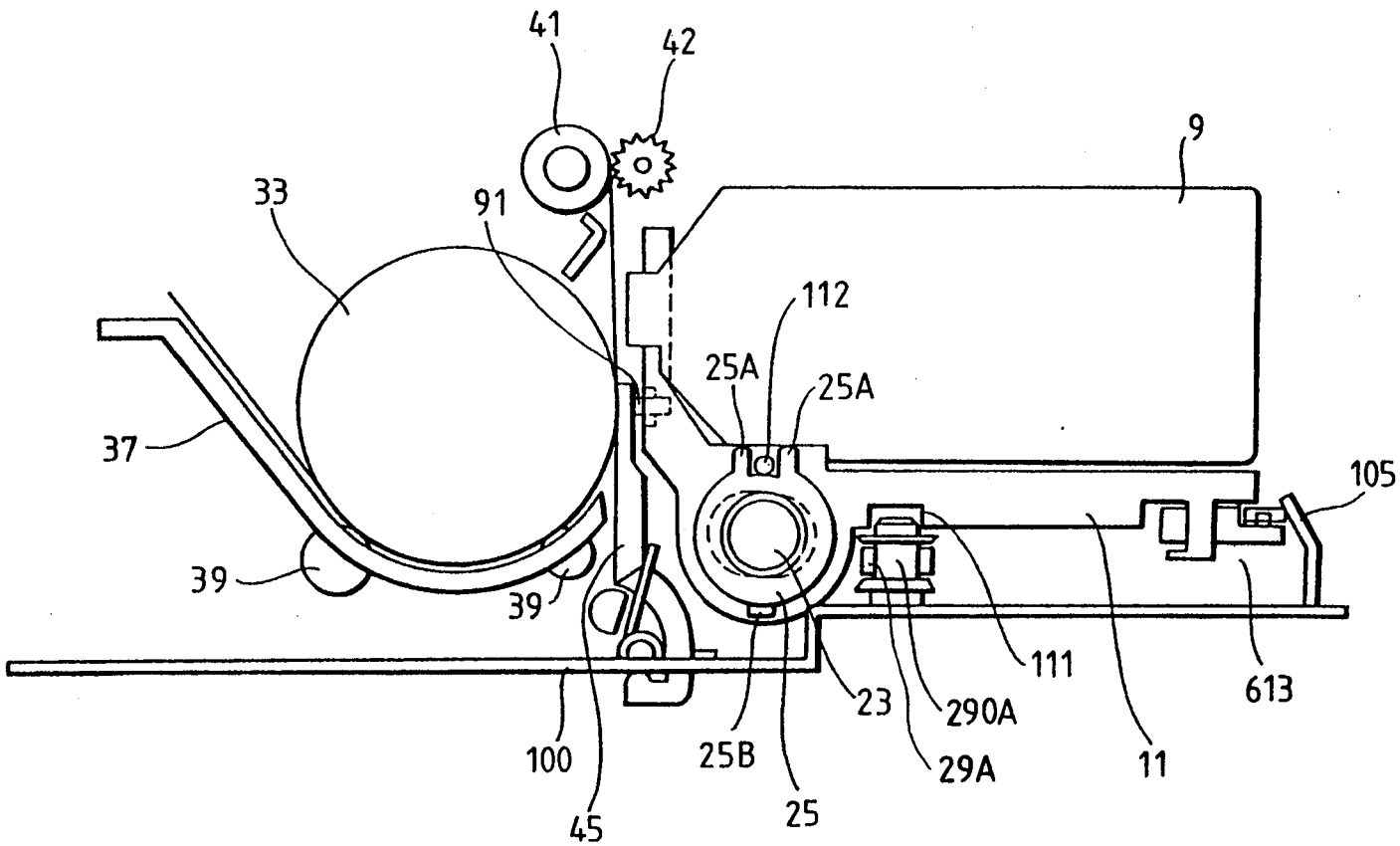
FIGS. 6 and 7 are a side view and a top view, illustrating coupling relation of the carriage shown in FIG. 2 and so forth to other elements.
Figure 7:
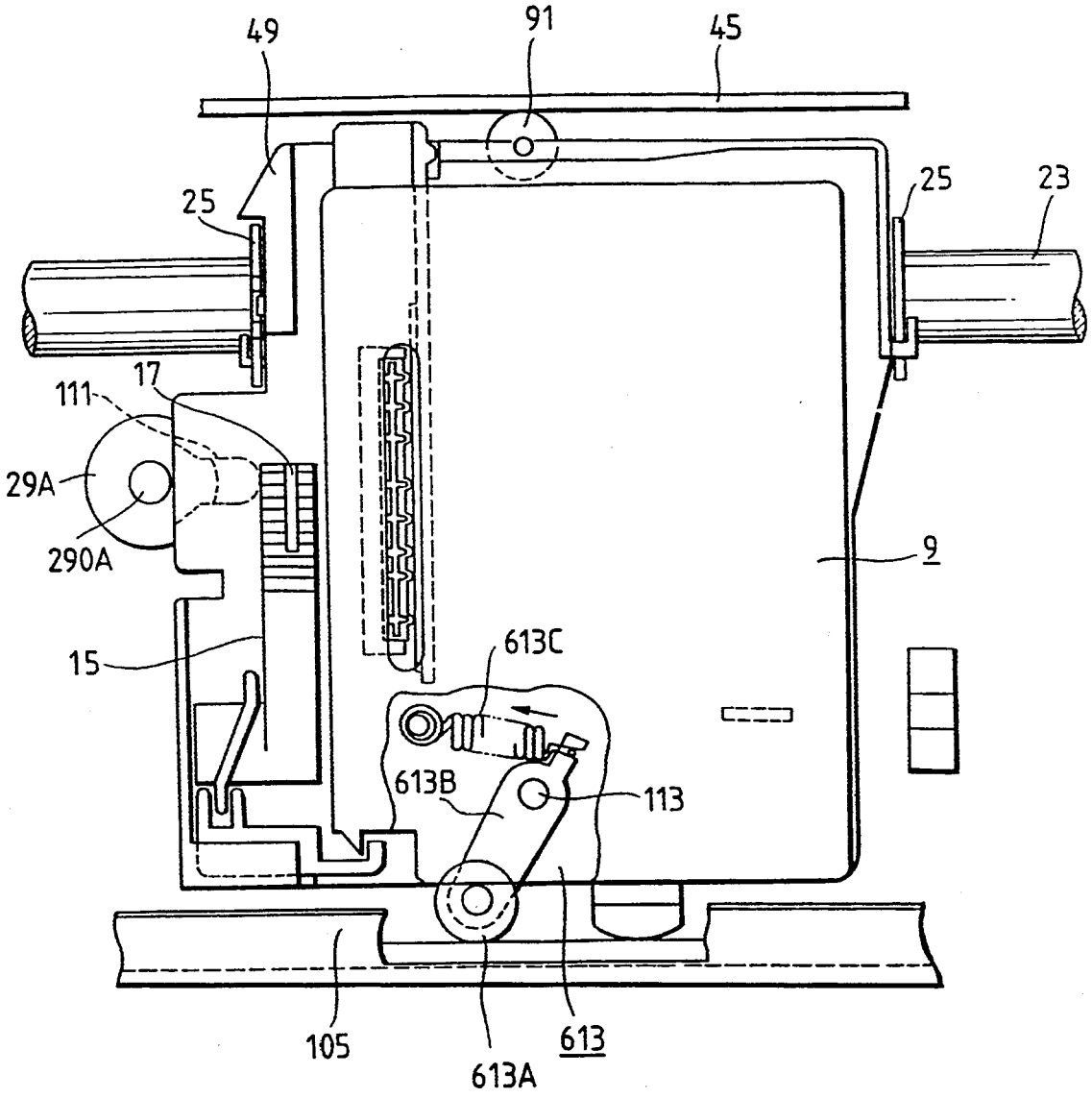

FIGS. 6 and 7 are a side view and a top view, respectively, showing mechanisms around the head cartridge shown in FIG. 2 and so forth.

Referring to these Figures, designated at 91 is a roller rotatably mounted on a front end portion of carriage 11. Roller 91 is provided such that it partly projects forwardly from the orifice-formed face of the head cartridge. The roller is in engagement with and rolls over paper keep plate 45. Designated at 613 is a roller spring provided at the rear end of carriage 11. Roller spring 613 consists of roller 613A, coupling member 613B rotatably supporting roller 613A and spring 613C for biasing coupling member 613B in a predetermined roptational direction. Roller 613A engages with and rolls over front end plate 105 erected from the front end portion of bottom plate 100 to extend parallel to the guide shaft noted above. Coupling member 613B is rotatably supported on predetermined shaft 113 of carriage 11. Spring 613C is supported on a predetermined shaft of carriage 11 and biases coupling member 213B about shaft 113 in the counterclockwise direction. By the above construction of roller spring 613, carriage 11 is biased at all time toward paper keep plate 45.

Designated at 25 are bearings coupled to guide shaft 23. They are each mounted on each side end portion of carriage 11. Bearings 25 have bearing portions eccentric with respect to case of the apparatus. Two bearings 25 are mounted such that they are eccentric in opposite directions. Bearing 25 on the side shown in FIG. 6 is pivotable about boss 112 provided on carriage 11. Carriage 11 has a slot formed in a portion, in which bearing 25 is mounted. Movement of two projections 25A is restricted in back-and-forth directions (i.e., transversal directions in FIG. 6). Thus, with movement of carriage 11 bearing 25 is rocked relative to carriage 11. Movement of bearing 25 in the direction of guide shaft 23 is restricted as projection 25B provided on shaft 25 is restricted by part of carriage 11.

Figure 8:
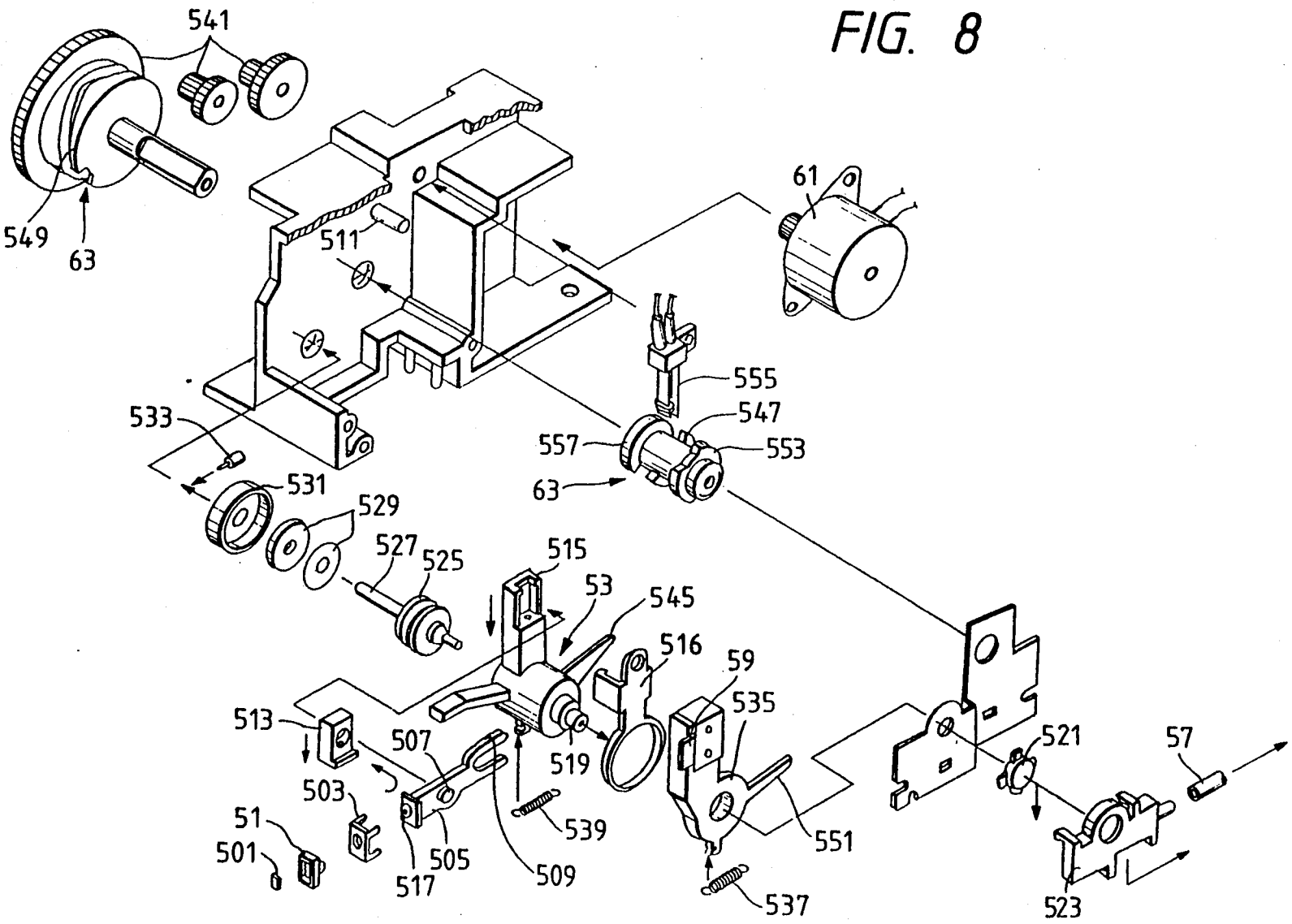
FIG. 8 is an exploded perspective view showing a discharging recovering mechanism.

FIG. 8 is an exploded perspective view showing an essential part of the jetting recoverying unit consisting of cap 51, pump 53, blade 59, motor 61, cam unit 63 and so forth shown in FIG. 2.

Referring to FIG. 8, designated at 501 is an ink absorber provided inside cap 51, at 503 is a holding member holding cap 51, and at 505 is a cap lever, which is rotatably mounted for rotation about pin 507 for engaging and disengaging cap 51 with respect to the orifice-formed face of jet unit 9*a*. Designated at 511 is a pin engaged with end 509 of cap lever 505 to define a range of rotation of cap lever 505.

Designated at 513 is a tool having a hole, into which pin 507 of cap lever 505 is inserted. The tool is used for mounting cap lever 505 on support 515 provided on pump 53. Designated at 516 is a retaining member for ensuring the mounted state. Designated at 517 is a force-applying section for acting to cap 51 a force tending to bring cap 51 into contact with the orifice-formed face. The force-acting section has inlet 517A, through which absorbed ink is introduced. Cap lever 505, pin 507, tool 513 and support 515 are formed with respective inner ink paths. When pump 53 provides absorbing force, ink is led through these paths as shown by arrow into pump 53.

Designated at 519 is a shaft projecting from the center of end face of pump 53. Pump 53 is rotatable about shaft 519. The rotational force is coupled to cap lever 505 via support 515, and as a result cap 51 is retreated. Joint 512 is coupled to member 523, on which tube 57 is mounted. Shaft 519, joint 521 and member 523 are formed with respective ink paths, and ink absorbed by pump 53 is led through these paths and tube 57 into waste ink tank 55 as shown by arrows in the Figure.

Designated at 525 is a piston of pump 53, at 527 is a shaft, at 529 is a packing, and at 533 is a pin mounted on piston shaft 527 and receiving transmitted force for operating piston shaft 527.

Designated at 535 is a blade lever with blade 59 mounted thereon. The blade lever is rotatably mounted on a shaft projecting from end face of pump 53, and as it is rotated, blade 59 is projected toward or retreated away from the recording head. Designated at 537 is a spring, which provides to blade lever 535 a rotational force in a direction to cause projection of blade 59. Designated at 539 is a spring providing pump 53 a tendency of rotation toward the recording head.

Designated at 541 is a gear train for transmitting the rotation of motor 61 to cam unit 63. Cam unit 63 includes cam 547 engaging with engagement member 545 provided on pump 53 for rotating the member, cam 549 engaging with pin 533 provided on piston shaft 527 of pump 53 for operating the pump, cam 553 engaging with engagement member 551 provided on blade lever 535 for rotating the member, and cam 557 engaging with switch 555 for detecting the home position of cam unit 63.

The operations of these cams will be described later.

Figure 9:
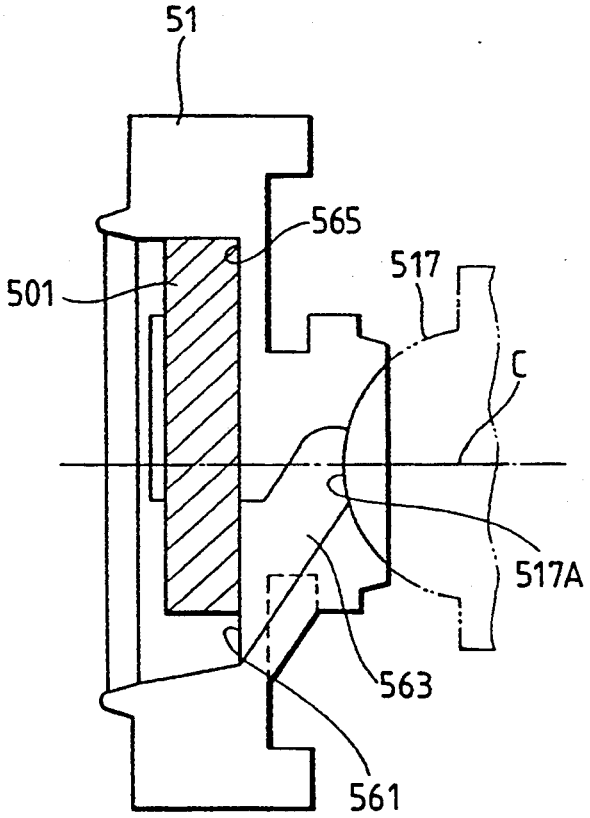
FIG. 9 is a side sectional view showing a cap section in the same mechanism.

FIG. 9 is a sectional view showing cap 51 and other components.

In this embodiment, ink absorbing port 561 in the cap is open in a downward direction, and ink path 563 is formed such that it leads to ink inlet 517A provided in operating portion 51 of cap lever 505. Absorbing port 561 is not completely covered by absorbing member 501.

With this construction, ink issued in a jetting recovering process or the like and flowing downwards due to the gravity is absorbed through a lower absorbing port 561, and therefore the amount of ink remaining in ink absorbing member 501 is extremely reduced. It is thus possible to greatly retard deterioration or the like of ink due to solidification thereof and hence extend the life of the ink absorbing member and cap 51 carrying the ink absorbing member.

Figure 10:
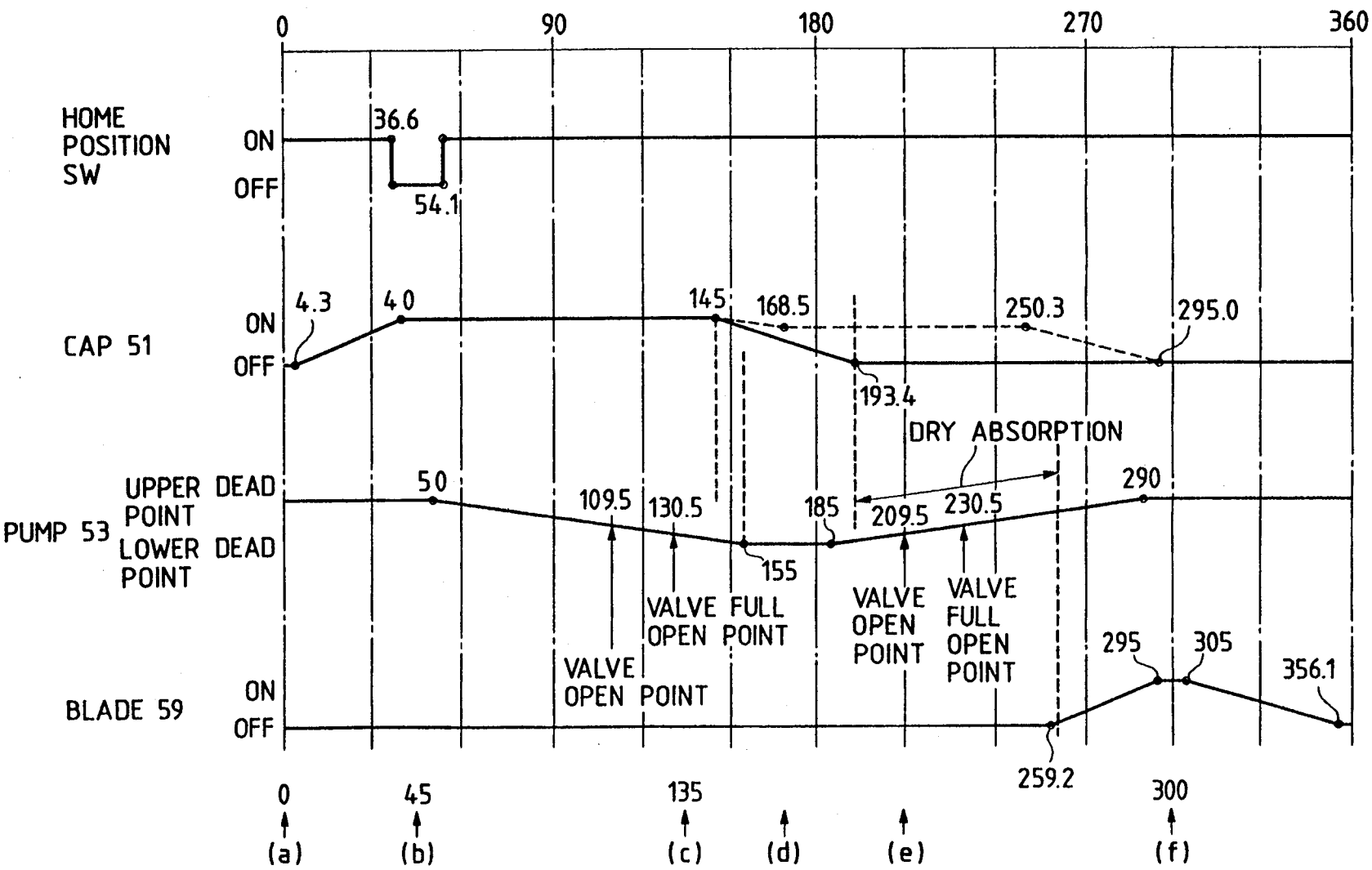
FIG. 10 is a timing chart showing a sequence of recovering operation in the same mechanism.
Figure 11:
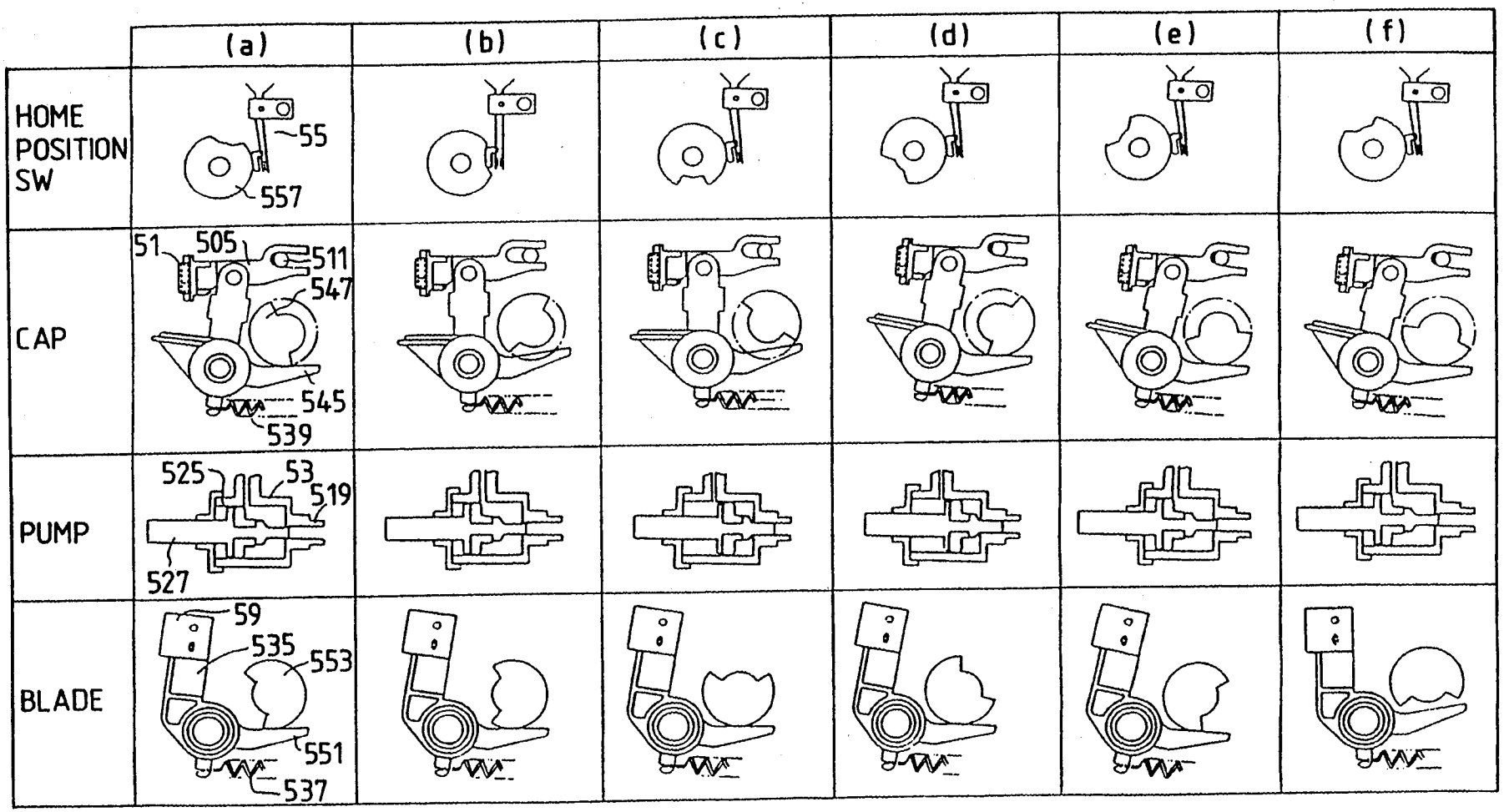
FIG. 11 is a sequential view illustrating operations of various parts in the discharging recovering operation of the above mechanism.

FIGS. 10 and 11 are respectively a view showing contour lines of individual cams of cam unit 63 and a view illustrating operating positions of various parts corresponding to respective cam positions. Numerical values in FIG. 10 represent rotational angles of the cams.

Referring to the Figures, shown at (a) are cam position and state of various parts when performing recording. In this instance, cap 51 and blade 59 are separated from the orifice-formed face of the recording head, and pump 53 is at its upper dead center. Shown at (b) is home position switch 55 at its "off" position. This position is referred to as home position of cam unit 63.

This position is set during waiting recording or the like. At this instance, cap 51 is covering the orifice-formed face, and blade 59 is retracted. Further, pump 53 is at its upper dead center.

When cam is rotated from position (b), piston 525 is moved toward the lower dead center with cap 51 held put on the orifice-formed face, and the negative pressure of the absorbing system leading to the cap is increased. Eventually, piston 525 reaches the ink inlet of the pump, and after a period, during which the ink inlet is closed (i.e., an "off" period of a valve), the valve turns to be opened (point of 109.5 degrees) to be fully opened (point of 130.5 degrees). Subsequently, piston 525 reaches position (c) near the lower dead center. At this position, the cam is held stationary for a predetermined period of time to effect sufficient absorbing in consideration of the resistance offered to fluid in the ink absorbing system, and then the cam is rotated again. Piston 525 then reaches the lower dead center, and cap 51 turns to be separated from the orifice-formed face. This position (d) is held for a predetermined period of time.

When the cam is subsequently further rotated, piston 52 turns to proceed toward the upper dead center again. During this course, the valve turns to be closed (point of 209.5 degrees) to be fully closed (point 230.5 degrees). Meanwhile, cap 51 at position (e) is separated from the orifice-formed face. In the neighborhood of this position, piston 525 is driven several times, whereby ink remaining in the ink absorbing system is absorbed toward the pump side (the absorption being referred to as idling absorption). Spaces on the opposite sides of piston 525 in the pump are communicated with each other by a flow path (not shown), which is closed when the piston is proceeding from the upper dead center to the lower dead center and is open when the piston is proceeding from the lower dead center to the upper dead center. Further, the space on the right side of the piston is communicating with a flow path provided in pump shaft 519. Thus, when piston 525 is proceeding from the lower dead center to the upper dead center during idling absorption, ink introduced into the space on the left side of the piston is transferred to the right side space. When the piston is proceeding from the upper dead center to the lower dead center, on the other hand, introduction of ink from the ink absorbing system into the left side space and discharging of ink from the right side space into the waste ink tank are effected.

When the cam is subsequently further rotated forwardly, blade 59 is projected to be ready for wiping (position (f)). When carriage 11 is moved toward a recording area in this state, blade 59 engages with the orifice-formed face of the head and wipes ink away from the face. Afterwards, the cam is further rotated to cause retreat of blade 55, and it is set at position (a). In this state, carriage 11 is moved toward the cap so that the orifice-formed face of the head faces cap 51. Then, the cam is moved to position (b) to put on the cap and is stopped.

When bringing about recording from the waiting state, the recording may be started after effecting wiping by projecting blade 59 with rotation of the cam caused in the positive or negative direction from position (b).

Figure 12:
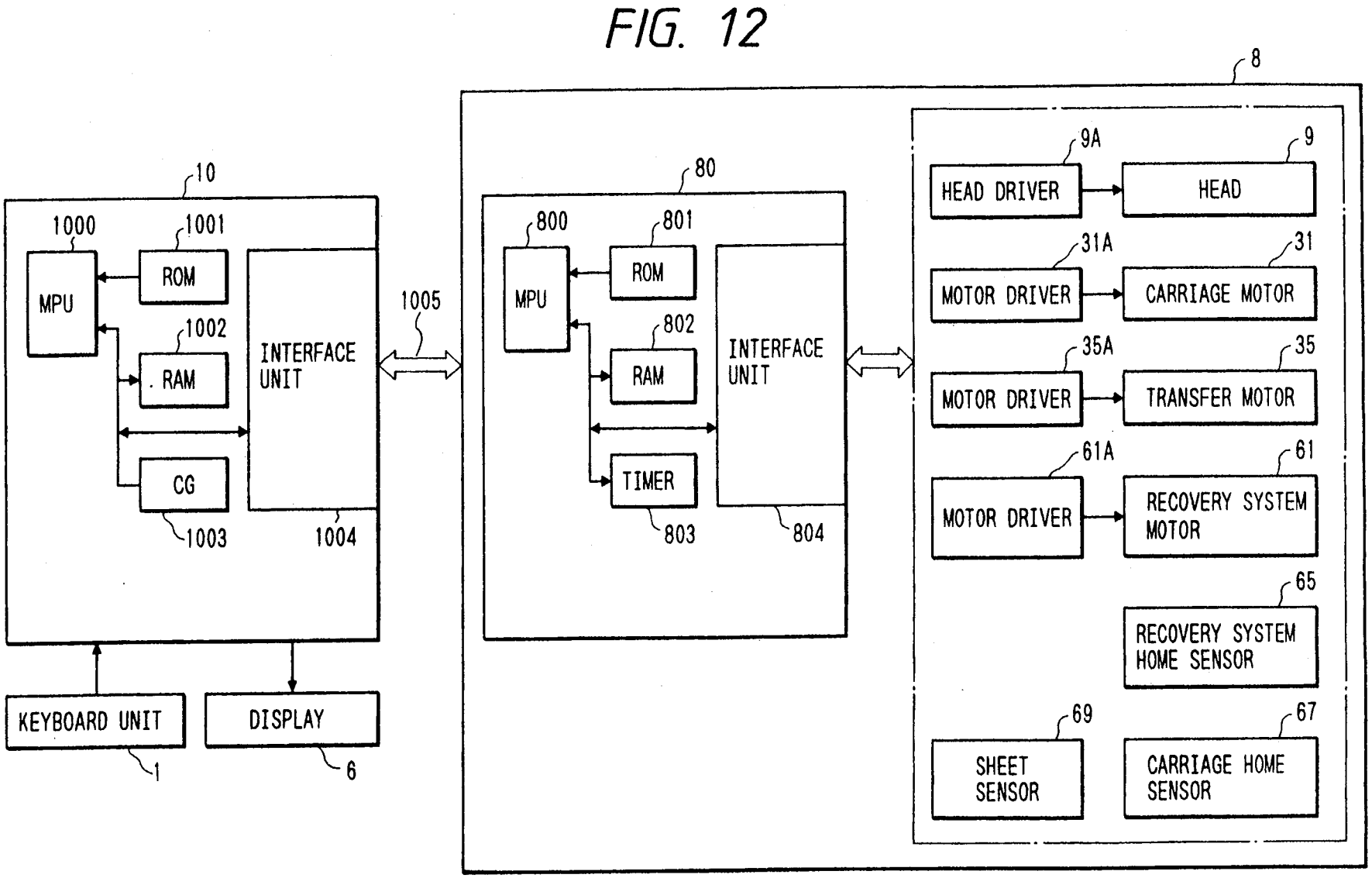
FIG. 12 is a block diagram showing a control system in the recording apparatus shown in FIG. 2 and so forth.

Now, a control system for controlling various parts of the document processing system having the above construction, will be described with reference to FIG. 12.

Referring to the Figure, designated at 10 is a control unit, which can process characters or the like input from key board unit 1 and display processed data on display 6 and operate printer unit 8 according to recording instructions from key board unit 1. Control unit 10 includes MPU 1000 for executing various control routines, ROM 1001 for storing the control routines and data, RAM 1001 used as work area or the like in the execution of control, CG 1003 for storing patterns of characters or the like input from key board unit 1, and interface unit 1004 for effecting connection to key board unit 1 and like external units. Control unit 10 and printer unit 8 are electrically connected to each other via signal line 1005.

Printer unit 8 includes printer control unit 80 for controlling head 9 and so forth to alleviate the load on control unit 10. Printer control unit 80 has substantially the same construction as control unit 10 and includes MPU 800, ROM 801, RAM 802, timer 803 for measuring time and interface unit 804.

In printer unit 8, head 9, carriage motor 31, feed motor 35 and recoverying system motor 61 are controlled by printer control unit 80, and they are driven by head driver 9A, and motor drivers 31A, 35A and 61A. These motors 31, 35 and 61 have DC motor construction, and their rotational direction is controlled according to the polarity of drive pulse. Further, printer control unit 80 can recognize capping position and moving position of carriage 11. Further, the control unit can recognize setting of recording medium in feed tray 4 on the basis of detection of paper sensor 69 of transmitting or reflecting type consisting of light-emitting and light-receiving elements.

In the above construction, when a document producing process is started and a print start command is provided with depression of a print key (not shown) on key board unit 1, MPU 1000 of control unit 10 converts an input document consisting of characters and the like into print data with reference to CG 1003. MPU 1000 adds control commands to print data thus obtained by conversion and transfers the resultant data through interface control unit 1004 and signal line 1005 to printer control unit 80. MPU 800 of printer control unit 80 receiving transferred data controls head 9 and so forth to effect printing while interpreting the control commands added to print data with reference to a command table stored in ROM 801.

Figure 13:
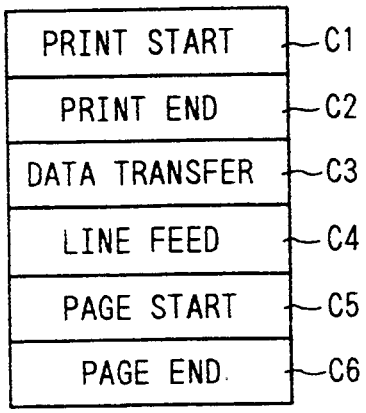
FIG. 13 is a command table showing commands used in the same control system.

FIG. 13 shows the control command table noted above stored in ROM 801 of printer control unit 80. Referring to the Figure, designated at C1 is a print start command instructing the start of printing, and at C2 a print end command instructing the end of printing. The print end command instructs the end of printing of the last page in case of data covering a plurality of pages. Designated at C3 is a data transfer command instructing transfer of print data in number corresponding to the number instructed by data which is transferred next. Designated at C4 is a line feed command instructing the end of one line, at C5 is a page start command instructing the start (or resumption) of one page, and at C6 is a page end command instructing the end of one page.

Figure 14:
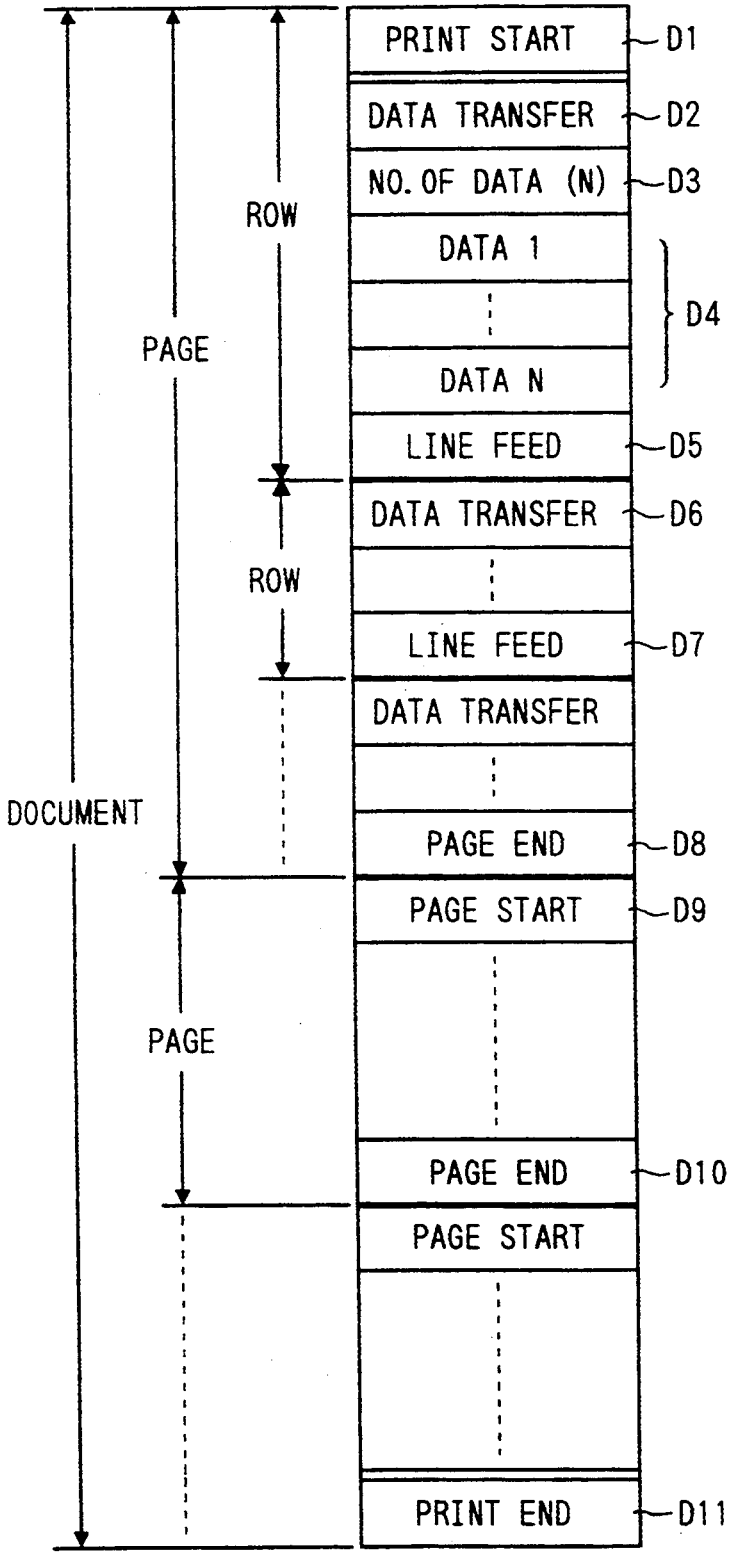
FIG. 14 is a format of data transferred in the same control system.

FIG. 14 is a view showing a format of data transferred from control unit 10 and printer control unit 80. In case of a document covering a plurality of pages, print start command D1 is transferred at first, and then data transfer command D2, transferred data number (N) D3, N data pieces D4 and line feed command D5 are transferred in the mentioned order. Up to this point, one line is printed.

Likewise, one line data from data transfer command D6 to line feed command D7 are transferred, and thereby one line is printed. After one line printing is executed repeatedly, page end command D8 eventually appears to complete printing of one page.

Likewise, one page data from page start command D9 to page end command D10 are transferred to effect one page printing. After one page printing is executed repeatedly, print end command D11 appears to bring an end to the printing of document covering a plurality of pages.

Now, a control routine receiving of printer control unit 80 receiving data transferred from control unit 10 will be described with reference to the flow charts of FIGS. 15 to 18 and timing charts of FIGS. 19 to 21.

Figure 15:
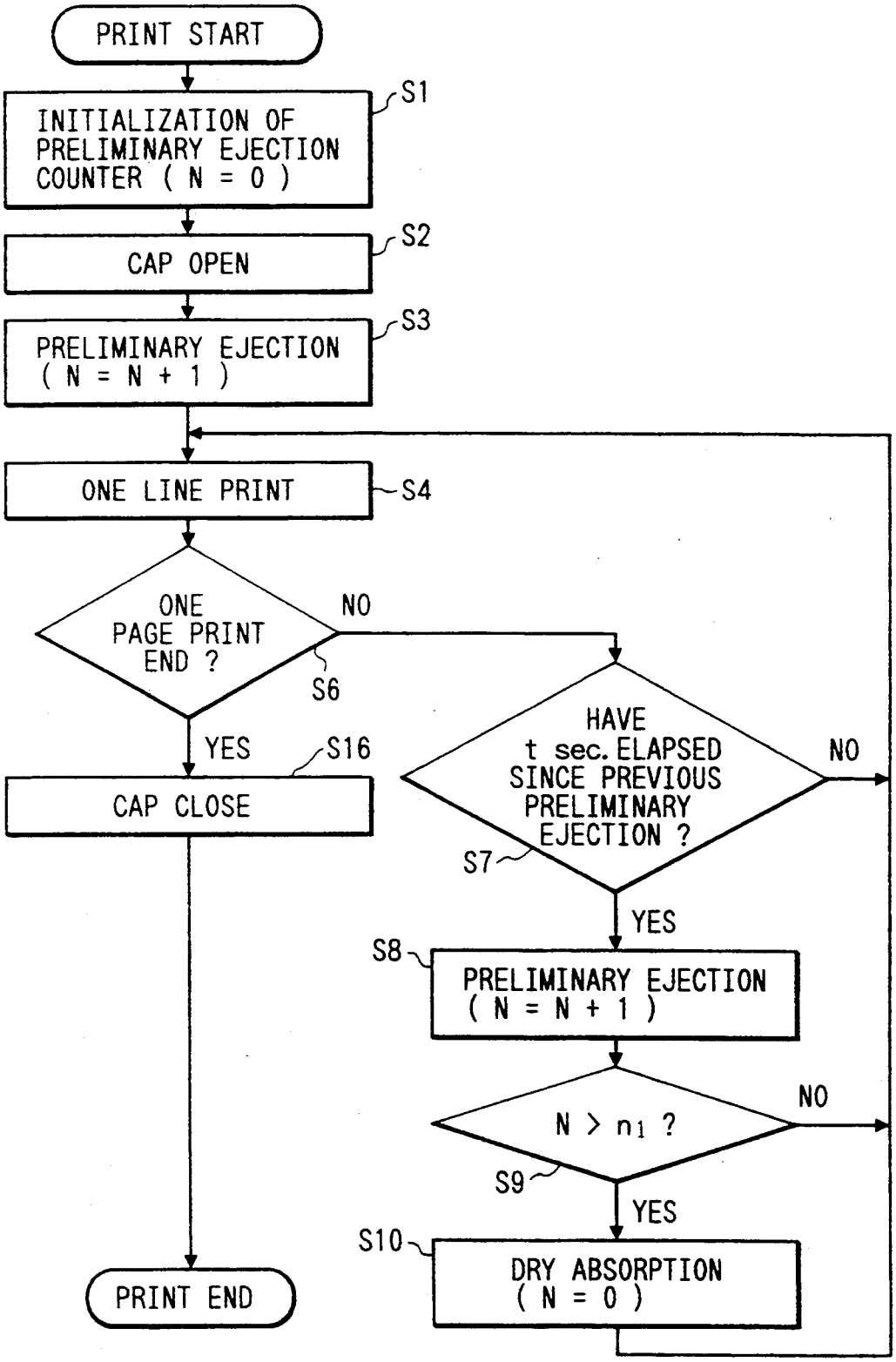
FIGS. 15 to 18 are flow charts illustrating control routine of a first embodiment of the invention in the above control system.

FIG. 15 illustrates a first example of control executed by printer control unit 80. This control routine is started if a print start data is provided as transferred data. Prior to the printing, MPU 800 initializes (N=0) an internal counter counting the number of times of preliminary ejection in step S1. Then in step S2 the MPU opens cap 51 to be ready for printing. This operation is executed with recovery system motor 61 driven by MPU 800 through motor driver 61A to move cam unit 63 from home position (b) to recording operation position (a) in FIGS. 10 and 11. In subsequent step S3, preliminary ejection is executed by driving head 9, and the counter is incremented (+1). The preliminary ejection is executed for head 9, which is liable to be defectively since ejectable if a long time has passed since the previous printing. In step S4, printing of one line is executed according to transferred print data.

In subsequent step S6 a check as to whether printing of one page is ended is executed through a check as to whether the pertaining command is a page end command. If printing of one page has not ended, a check is done in step S7 as to whether t seconds has passed since the previous preliminary ejection. If t seconds has not passed, the routine goes back to step S4. If t seconds has passed, step S8 is executed to effect preliminary ejection with carriage 11 moved to the position of preliminary ejection by driving carriage motor 31 and also to increment the counter. When recording is done with the ink jet recording head, there are some discharging orifices which are less frequently used according to the print pattern. Therefore, it is liable that ink present in the discharging orifices which are not used or are less frequently used becomes defectively ejectable and unsuited for ejection due to viscosity increase caused by evaporation of its solvent. To avoid this defectively ejectable state, preliminary ejection is done periodically (for every t seconds) during printing.

Insubsequent step S9 a check is done as to whether count value N of the counter exceeds predetermined number n1. If the number is exceeded, the routines goes back to step S4. If the count N is exceeding n1, step S10 is executed to effect dry absorption and initialize the counter (N=0), and the routine goes back to step S4. This operation of dry absorption is effected by driving recovery system motor 61 such as to move cam unit 63 from recording position (a) to dry absorption position in FIGS. 10 and 11. If it is found in step S6 that printing of one page is ended, cap 51 is closed in step S16, thus putting an end to the printing. This operation is effected by driving recovery system motor 61 such as to move cam unit 63 from recording position (a) to home position (b). When the produced document covers a plurality of pages, the above control is repeatedly executed from step S2.

Now, the above operation of the first example of control will be described with reference to (a) and (b) in FIGS. 19 to 21. In these Figures, shown in (a) is the number of times of preliminary ejection executed for each page. In the cases of FIGS. 19 to 21, the number of times of preliminary ejection for each page is 20, 14 and 6, respectively. Numerical Figures shown in (b) to (e) are numbers of times of preliminary ejection after previous dry absorption at the time of dry absorption.

Shown in (b) is the timing of dry absorption in the first control example. In this instance, dry absorption is executed for every 16 times of preliminary ejection. Here, it is assumed that the ink receiving capacity of cap 51 having absorbing member 501 as noted above is such as to be above the volume of ink ejected in 20 times of preliminary ejection, and predetermined number n1 is set to 15 by taking redundancy for several times into consideration.

As shown, in this first control example ink received in ink absorbing member 501 as a result of preliminary ejection increases with increase of the number of times of preliminary ejection, but with dry absorption executed when the number of times of preliminary ejection exceeds predetermined number n1 after the previous dry absorption ink received in ink absorbing member 501 is absorbed to the pump side. Thus, opportunity of dry absorption during printing is reduced by controlling the number of times of preliminary ejection with predetermined number n1 set according to the ink receiving capacity of ink absorbing member 501. It is thus possible to reduce delay of printing time due to execution of dry absorption during printing.

In addition, ink received in ink absorbing member 501 is absorbed to the pump side without flooding, and thus it is possible to prevent deterioration of ink absorbing capacity or reduction of absorbing force due to solidification of ink in the ink absorbing member.

Figure 16:
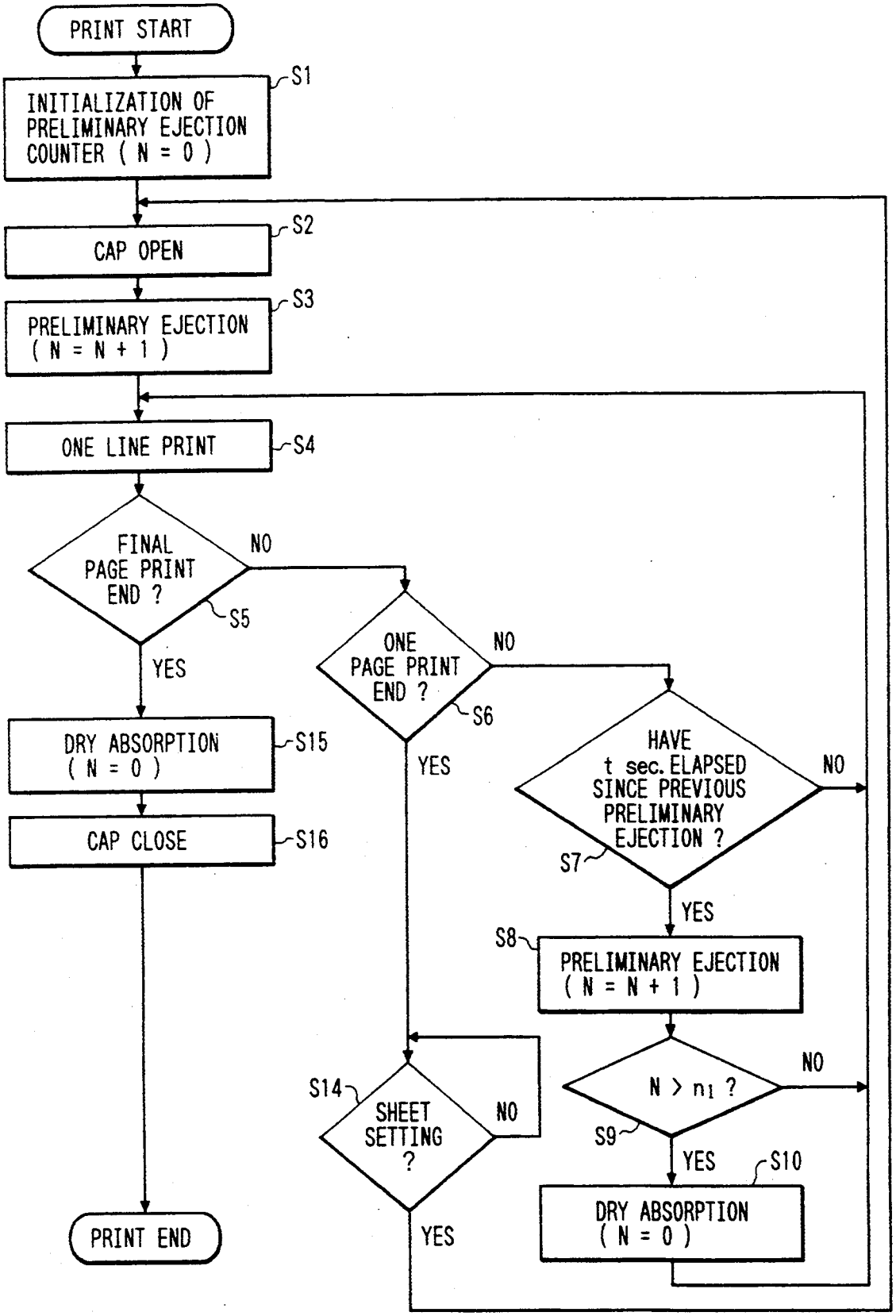

FIG. 16 shows a second example of control by printer control unit 80. This example is intended to improve dry absorption at the end of printing of the last page in the preceding first control example. In the Figure, steps like those in FIG. 15 are designated by like reference numerals, and their description is not given.

Referring to the Figure, a check is done in step S5 as to whether printing of the last page is ended through a check as to whether a control command is a print end command. If the command is not a print end command, the routine goes to step S6. If the printing of the last page is ended, dry absorption is executed in step S15 irrespective of the number of times of preliminary ejection, and the counter is initialized. In subsequent step S16, cap 51 is closed to bring an end to the printing.

If it is found in step S6 that printing of one page is ended, a check is done in step S14 as to whether setting of a sheet is detected by paper sensor 69. If the setting is detected, the routine goes back to step S2 to start printing of the next page.

Figure 19:
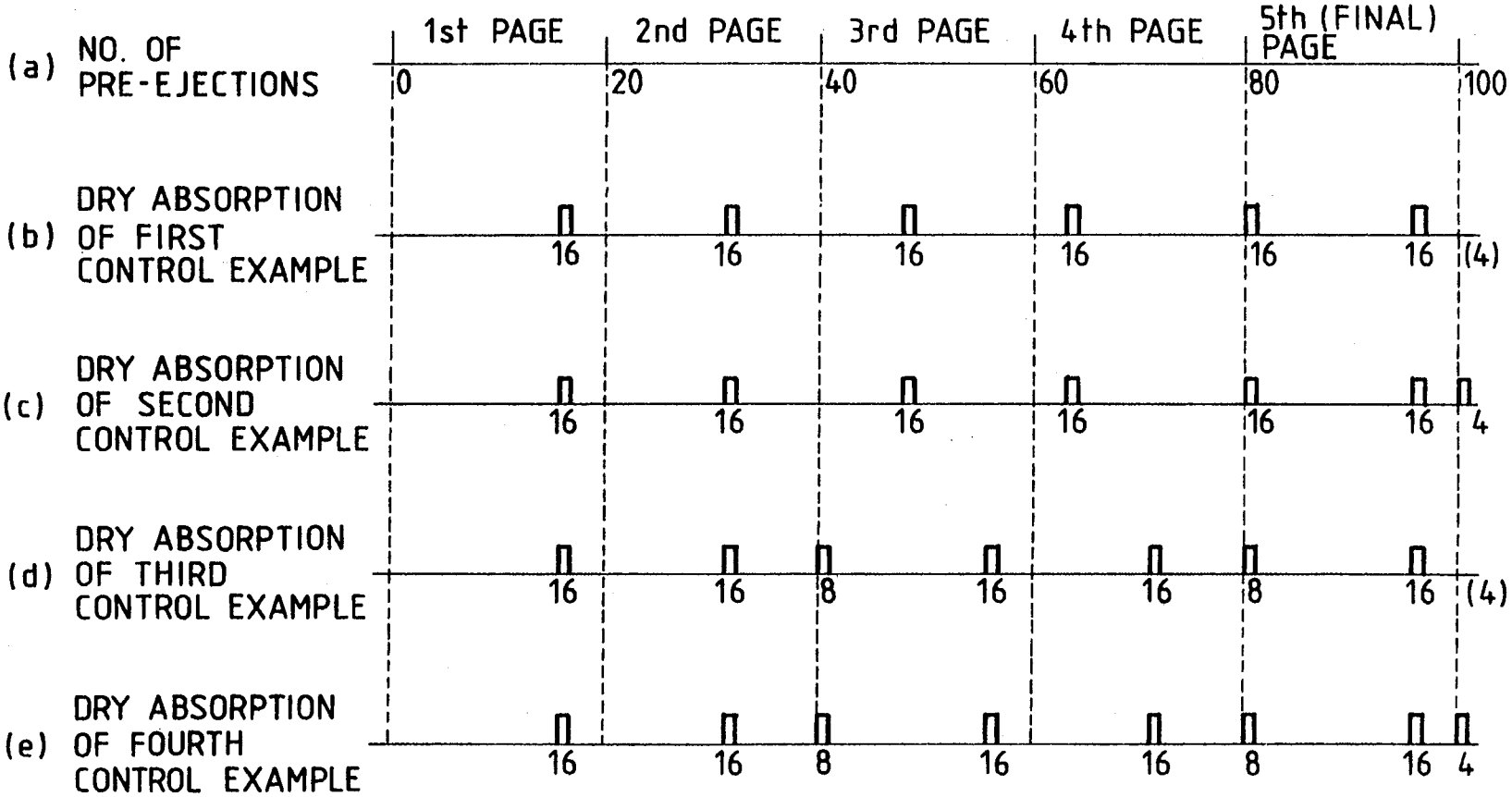
FIGS. 19 to 21 are timing charts illustrating operation the first embodiment of the invention in the above system.
Figure 20:
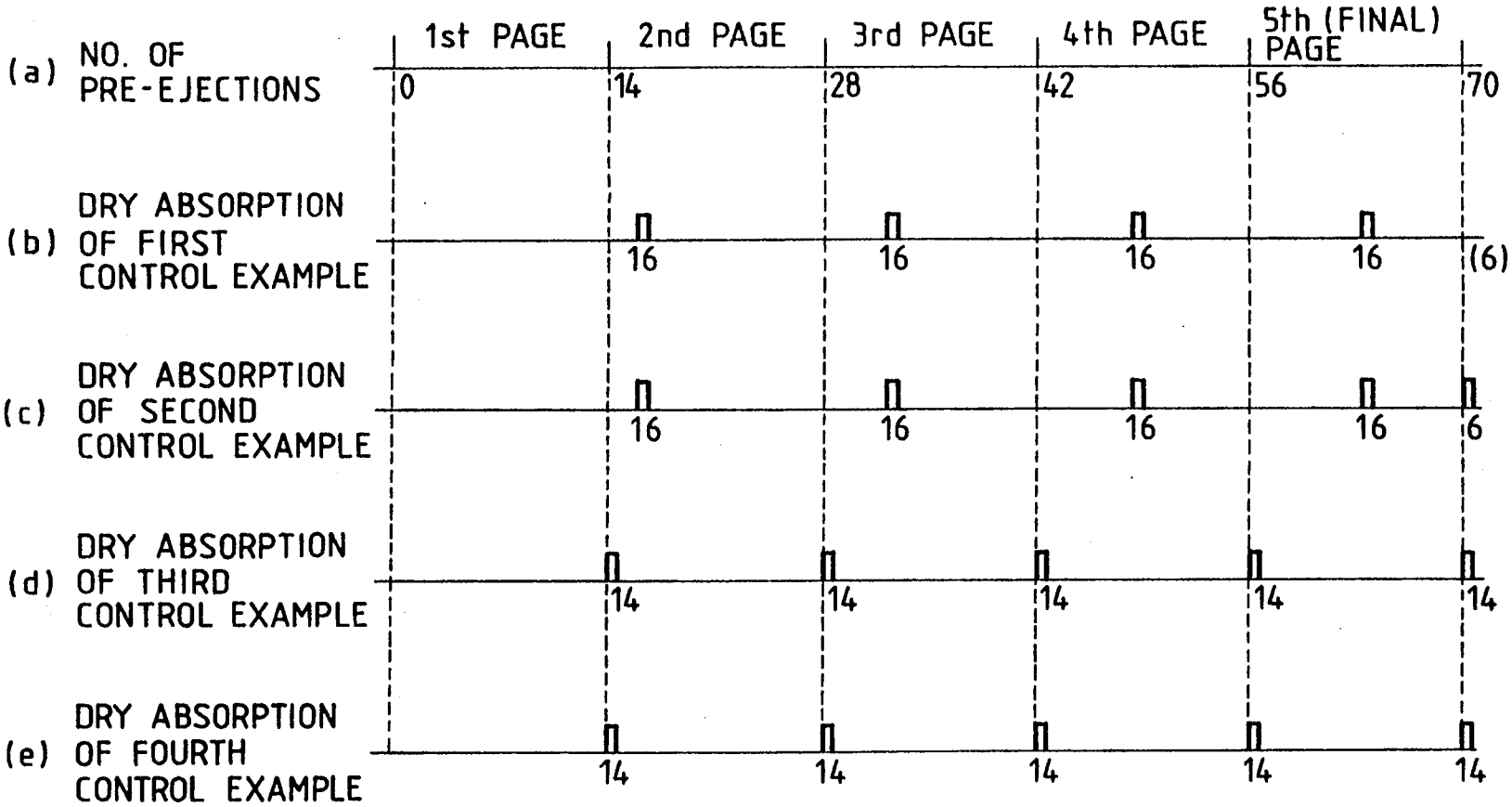
Figure 21:
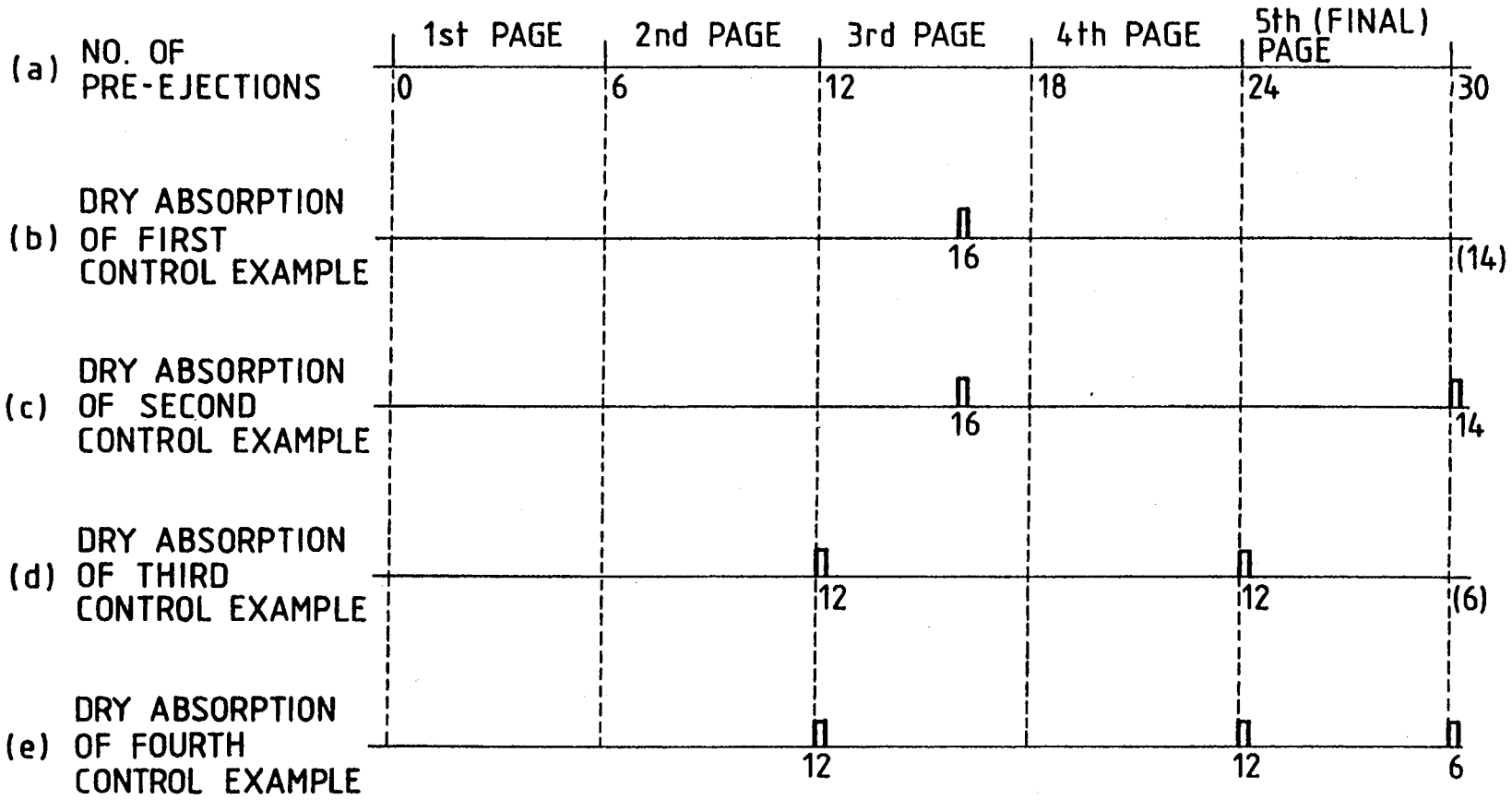

Referring to (c) in FIGS. 19 to 21 showing the timing of dry absorption in the second control example, at the end of printing of the 5-th (i.e., last) page, number N of times of preliminary ejection after the previous dry absorption is 4, 6 and 14, respectively. It is shown that dry absorption is done even if predetermined number n1 of 15 is not exceeded.

Thus, in this second control example, in addition to the first control example, dry absorption is always executed at the end of printing of the last page, and therefore there is no possibility of ending printing while leaving ink remaining in the cap as a result of preliminary ejection. It is thus possible to prevent reduction of deterioration of the ink receiving capacity or reduction of absorbing force that might otherwise result from solidification of ink in the ink absorbing member.

Figure 17:
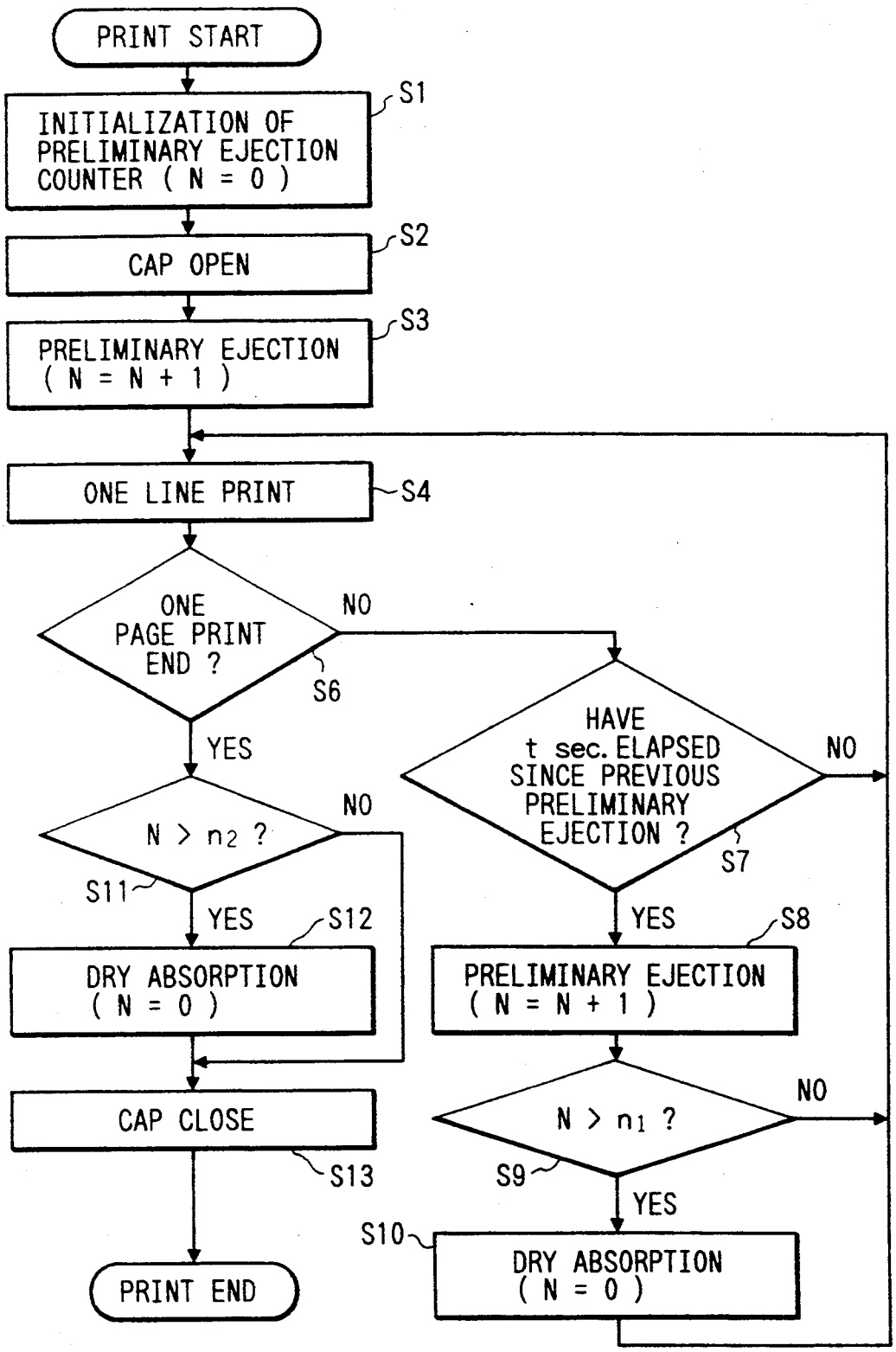

FIG. 17 shows a third example of control in printer control unit 80. This example is intended to improve reduction of the number of times of dry absorption during printing with respect to the previous first control example. More specifically, dry absorption is executed if the number of times of preliminary ejection exceeds predetermined number n2 ($n2 \leqq n1$) after the previous dry absorption at the end of printing of one page, thus increasing the number of times of dry absorption at the end of printing of each page and reducing the number of dry absorptions during printing. In the Figure, steps like those in FIG. 15 are designated by like reference symbols, and their description is not given.

Referring to the Figure, if it is judged in step S6 that printing of one page has ended, a check is done in step S11 as to whether count N of the counter exceeds predetermined number n2 ($n2 \leqq n1$). If n2 is not exceeded, dry absorption and counter initialization are executed in step S12, and in step S13 cap 51 is closed to bring an end to the printing.

If n2 is not exceeded, dry absorption is not executed, and the routine goes to step S13 to close cap 51, thus bringing an end to the printing. If the produced document covers a plurality of pages, the above control is repeatedly executed from step S2.

Shown in (d) in FIGS. 19 to 71 is the timing of dry absorption in the third control example. Here, predetermined number n2 is set to 7, which is about one half of n1. In the case of (d), the number of dry absorption at the end of page printing increased compared to is the case of the first control example shown in (a). In case of (d) in FIGS. 20 and 21, no dry absorption is executed during printing. Particularly, in FIG. 20 dry absorption, which is executed 4 times during printing in the first control example (a), is not executed at all in the third control example (c).

As shown above, in the third control example number n2 of times of preliminary discharge after previous dry absorption at the end of page printing is set to be less than number n1 of times of preliminary ejection after previous dry absorption at the end of printing of each page. Thus, the number of times of dry absorption executed during printing is reduced, and opportunity of executing dry absorption at the end of printing of each page is increased.

Thus, the number of times of dry absorption executed during printing is reduced to permit reduction of printing time necessary for one page.

While the number of times of dry absorption at the end of printing of one page is increased by reducing the number n2, if the number is set to be too small, dry absorption always takes place at the end of page printing. On the other hand, if the number is set to be excessively large, dry absorption takes place during printing of the next page. Accordingly, number n2 is desirably about one half of the number n1.

Further, it is possible to further reduce delay of printing time due to dry absorption by carrying out dry absorption concurrently with page discharge which is done at the end of page printing.

Figure 18:
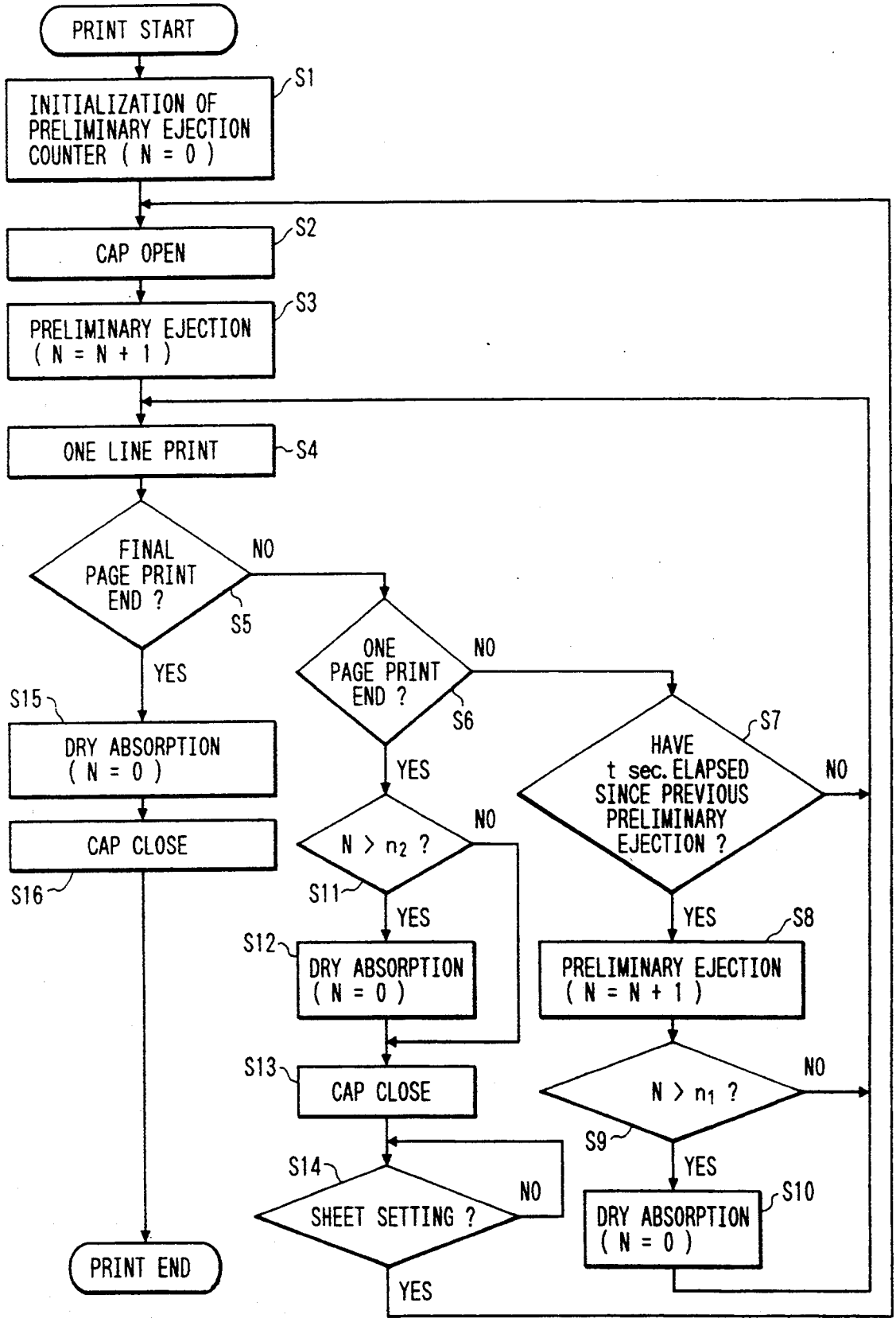

FIG. 18 shows a fourth example of control of printer control unit 80. In this example, features of the second and third control examples are added to the first control example. More specifically, the added features are steps S5, S14 and S15 in FIG. 16 showing the second control example and steps S11 through S13 in FIG. 17 showing the third control example.

As shown in (e) in FIGS. 19 to 21 showing the timing of dry absorption in the fourth control example, the number of times of dry absorption during printing is reduced compared to the cases of first and second control examples shown in (b) and (c), and dry absorption at the end of printing of the 5-th (i.e., last) page, which is not executed in the first and third control examples shown in (b) and (d).

As shown above, in the fourth control example dry absorption is executed when the number of times of preliminary ejection executed after the previous dry absorption during printing is n1 at the end of one page printing and when the number of times of preliminary ejection executed after the previous dry absorption is exceeds n2 ($n \leqq n1$) at the end of printing of that page. Further, dry absorption is always executed at the end of printing of the last page.

Thus, while ink received in ink absorbing member 501 as a result of preliminary ejection is increased with increasing number of times of preliminary ejection, during printing dry absorption is executed before ink leaks out of cap 51. Further, the number of times of dry absorption executed at the end of each page printing is increased, while the number of times of dry absorption executed during printing is reduced. Thus, it is possible to reduce time for one page printing. Further, at the end of printing of the last page dry absorption is always done. Thus, there is no possibility of ending printing while leaving remaining ink in cap 51 produced as a result of preliminary ejection, and it is possible to prevent deterioration of ink absorbing capacity or reduction of ink absorbing force which might otherwise be caused by solidification of ink in ink absorbing member 501.

In the above first embodiment of ink jet recording apparatus, while ink received in the cap as a result of preliminary ejection is increased with increasing number of times of preliminary ejection, when the number of times of preliminary ejection exceeds a predetermined number after the previous dry absorption, dry absorption is executed to absorb ink received in the cap. That is, the number of times of preliminary ejection executed can be controlled by setting the predetermined number noted above according to the ink receiving capacity of the cap, and thus it is possible to eliminate unnecessary dry absorption and thus reduce the number of times of dry absorption.

Figure 22:
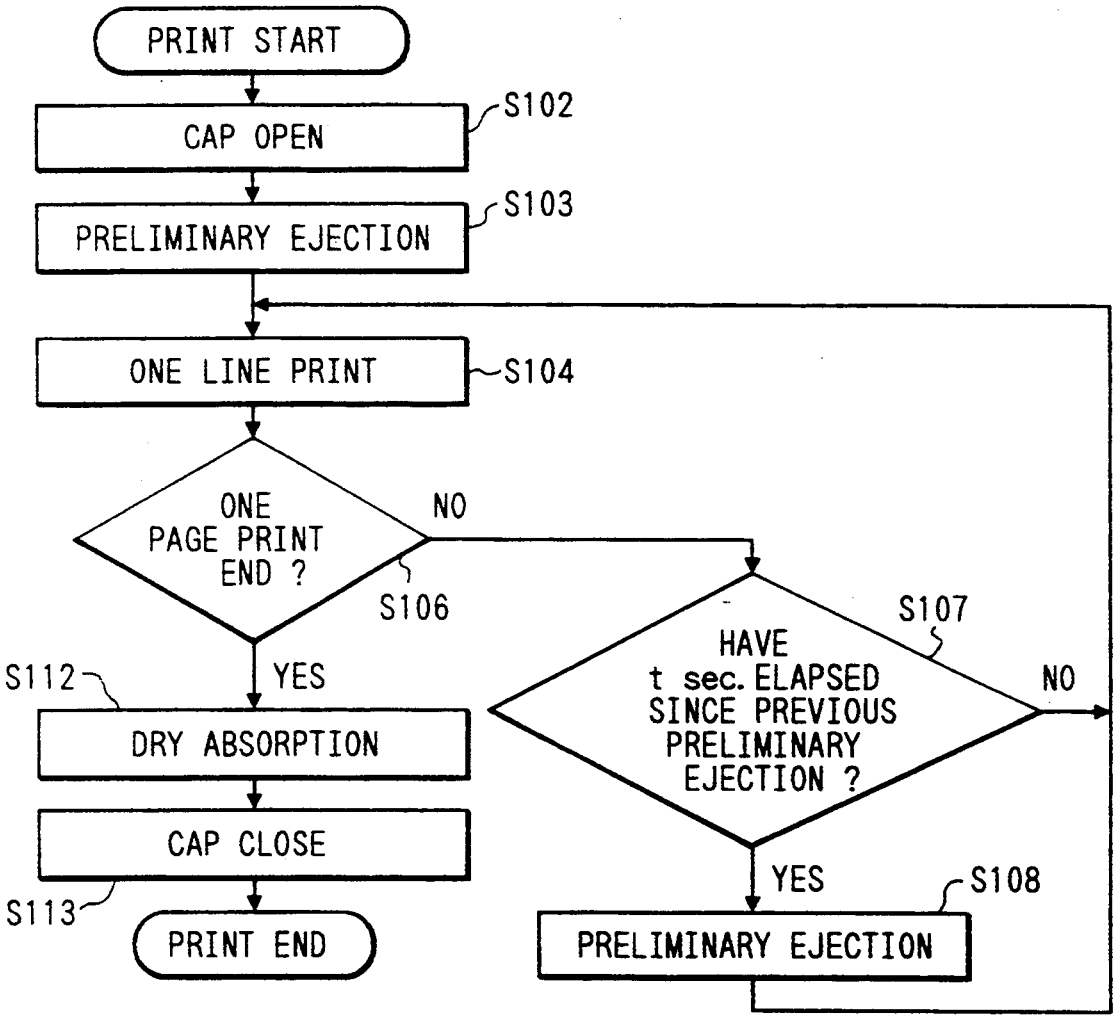
FIGS. 22 to 24 are flow charts illustrating control routine in a second embodiment of the invention in the above control system.

Now, a second embodiment of the invention will be described. The construction of mechanism and control system of this embodiment are the same as those shown in FIGS. 1 to 12, and their description is not given. Now, a control routine of the second embodiment will be described with reference to the flow charts shown in FIGS. 22 to 24 and timing chart shown in FIG. 25.

FIG. 72 shows a first example of control by printer control unit 80 in the second embodiment. When a print start command is found as transferred data, this control routine is started. Prior to printing, MPU 800 opens cap 51 in step S102 to be ready for printing. This operation is executed by driving recovery system motor 61 through motor driver 61A such that cam 63 is moved from home position (b) to recording position (a) shown in FIGS. 10 and 11. In subsequent step S103 preliminary ejection is executed by-driving head 9. This is done so for head 9 is liable to be defectively dischargeable if long time has passed since the previous printing. In subsequent step S104, printing for one page is executed according to transferred print data.

In subsequent step S106 a check as to whether printing of one page has ended is executed through a check as to whether command is a page end command. If printing of one page has not been ended, a check is done in step S107 using timer 803 as to whether t seconds has passed since the previous preliminary ejection. If t seconds as not been passed, the routine goes back to step S104. If t seconds has passed, step S108 is executed to move carriage 11 to the preliminary ejection position by driving 31. The routine S104 then goes back to step S104. When performing recording with the ink jet recording head, there arise ink discharging orifices which are not or less frequently used according to print pattern. For this reason, it is liable that ink present in discharging orifices which are not or less frequently used becomes defectively ejectable and unsuited for ejection due to viscosity increased caused by evaporation of its solvent. To avoid this defectively ejectable state, preliminary ejection is done periodically (i.e., for every t seconds) during printing.

If it is found in step S106 that printing of one page has ended, dry absorption is executed in step S112, and in step S113 cap 51 is closed to bring an end to printing. This operation is executed by performing dry absorption with recovery systemmotor 61 driven such that cam unit 63 is moved from recording position (a) to home position (b) FIGS. 10 and 11 and then in closing cap 51 by driving recovery system motor 61 to bring it to home position (b). When the produced document covers a plurality of pages, the above control is repeatedly executed.

Now, the operation of first control example of the second embodiment will be described with reference to (a) to (e) in FIG. 25. Shown in (a) in the Figure is a timing of opening or closing cap 51. This timing occurs at the start and end of page printing and also when no data has been transferred from control unit 10 for a predetermined period of time. Shown in (b) is a timing of preliminary ejection. This timing occurs when opening cap 51 and also when t seconds has passed since the previous preliminary ejection. Shown in (c) is a timing of data transfer from control unit 10. Interruption of data transfer occurs because control unit 10 requires time for conversion to print data.

Shown in (a) is a timing of dry absorption as in the conventional case and executed in an interlocked relation to the capping. Thus, for the 1-st and 2-nd pages, for which capping is effected during printing, dry absorption is executed by a corresponding number of times, thus correspondingly delaying printing time.

In the first control example, on the other hand, dry absorption is not interlocked to the capping but takes place at the end of page printing as is seen from (e). In this case, therefore, dry absorption does not take place if capping is executed during printing.

As shown, with the first control example ink received in ink absorbing member 501 of cap 51 is absorbed to the pump side at the end of printing of each page, thus preventing deterioration of ink absorbing capacity and reduction of ink absorbing force that might otherwise result from solidifition of ink in ink absorking member 501.

Further, since dry absorption is not executed during printing, the printing time can be reduced.

If dry absorption is carried out concurrently with paper discharging which is done at the end of page printing, the delay of printing time due to dry absorption can be further reduced.

Figure 23:
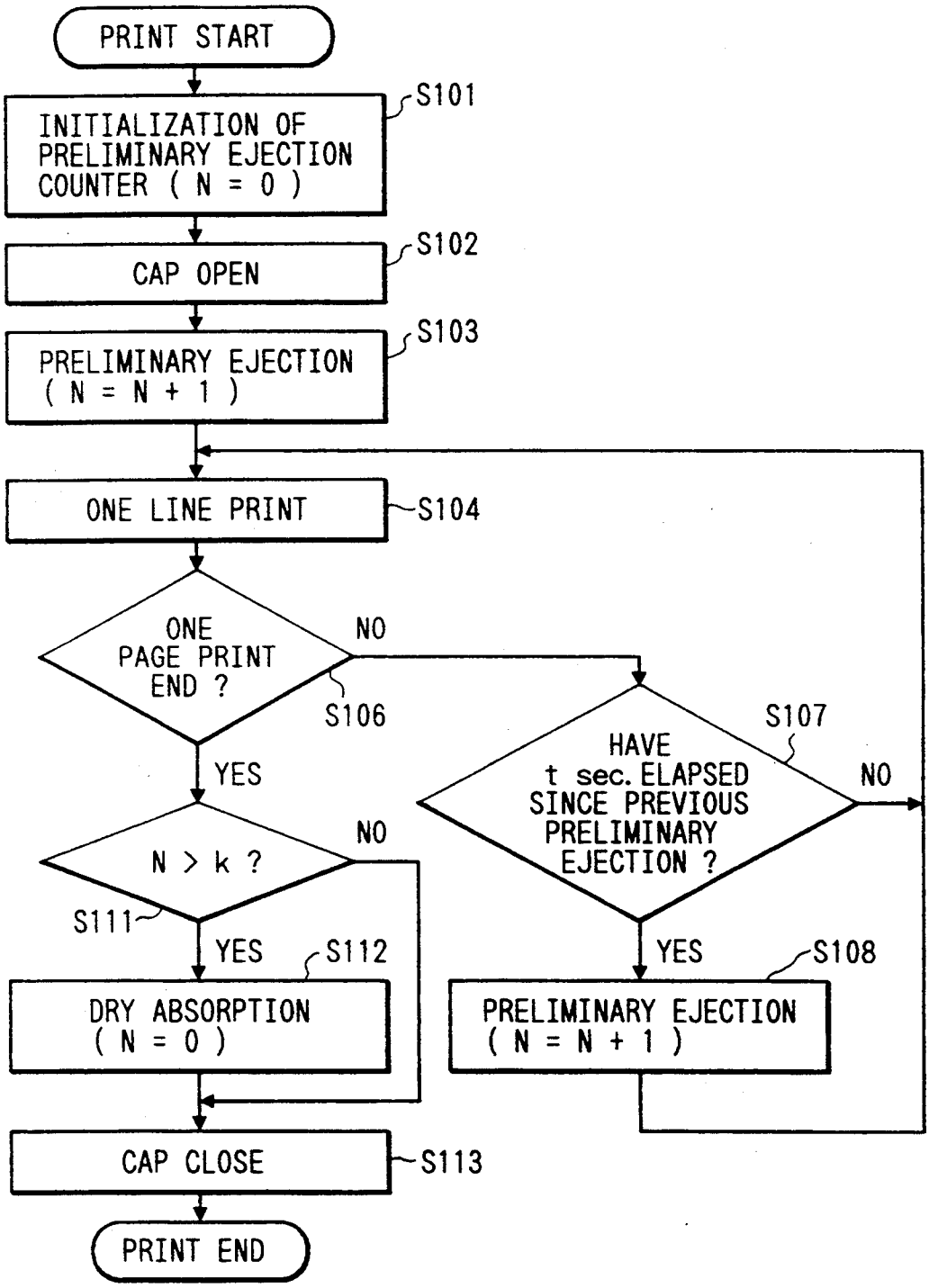

FIG. 23 shows a second example of control of printer control unit 80. This example is intended to further reduce the number of times of dry absorption compared to the first control example. More specifically, dry absorption is executed if the number of times of preliminary ejection is exceeding predetermined number K after the previous dry absorption at the end of printing of one page. This means carrying out dry absorption in the case of lack of sufficient redundancy of ink receiving capacity of cap 51 at the end of printing of one page for the ink receiving capacity is such as to be able to receive ink elected in a plurality of times of preliminary ejection.

Referring to the Figure, when a print start command is provided, MPU 800 initializes internal counter (N=D) counting the number of times of preliminary ejection in step S101. Then, it opens cap 51 in step S102 and executes preliminary ejection and incrementation (+1) of the counter in step S103. Subsequently, it executes printing of one line in step S104.

Subsequently, a check is done in step S106 as to whether printing of one page has been ended. If the printing has not be ended, a shcek is done in step S107 as to whether t seconds has passed since the previous preliminary ejection. If t seconds has not been passed, the routine goes back to step S104. If t seconds has been passed, preliminary ejection is effected and the counter is incremented in step S103, and then the routine goes to step S104.

If printing of one page has been ended, a check is done in step S111 as to whether count N of the counter is exceeding predetermined number K. If K is exceeded, dry absorption is executed and the counter is initialized in step S112. In subsequent step S113 cap 51 is closed to bring an end to the printing. If K is not exceeded, dry absorption is not executed, but the routine goes to step S113 to close cap 51 so as to pring an end to the printing. When the produced document covers a plurality of pages, the above control is repeatedly executed from step S102.

Now, the operation of the second control example in the second embodient will be described with reference to (B), (c) and (F) in FIG. 15. In this instance, the ink receiving capacity of cap 51 having ink absorbing member 501 corresponds to 20 times of preliminary ejection, and accordingly number K is set to 7.

Referring to the Figure, at the end of printing of one page, at which time number N in (b) is 5, dry absorption is not executed. At the end of page printing of the second page, at which time N, i.e., the number of times of preliminary ejection, is 10, dry absorption is executed ((f) in the Figure). Likewise, at the end of printing of the third page (i.e., last page), at which time number N is 5, dry absorption is not executed.

As has been shown, in the second control example it is possible to produce the number of times of dry absorption executed at the end of one page printing in addition to obtaining the same effects as in the first control example, and this means that the delay of printing time due to dry absorption can be further reduced.

By increasing number K the number of times of dry absorption executed at the end of one page printing is correspondingly reduced. However, if N is set to an excessively large number, the amount of ink ejected in preliminary ejection during printing of the next page is liable to exceed the ink receiving capacity of the cap, resulting in leakage of ink from the dap. For this reason, number K is desirably less than one half, more preferably about one third, of the ink receiving capacity.

Figure 24:
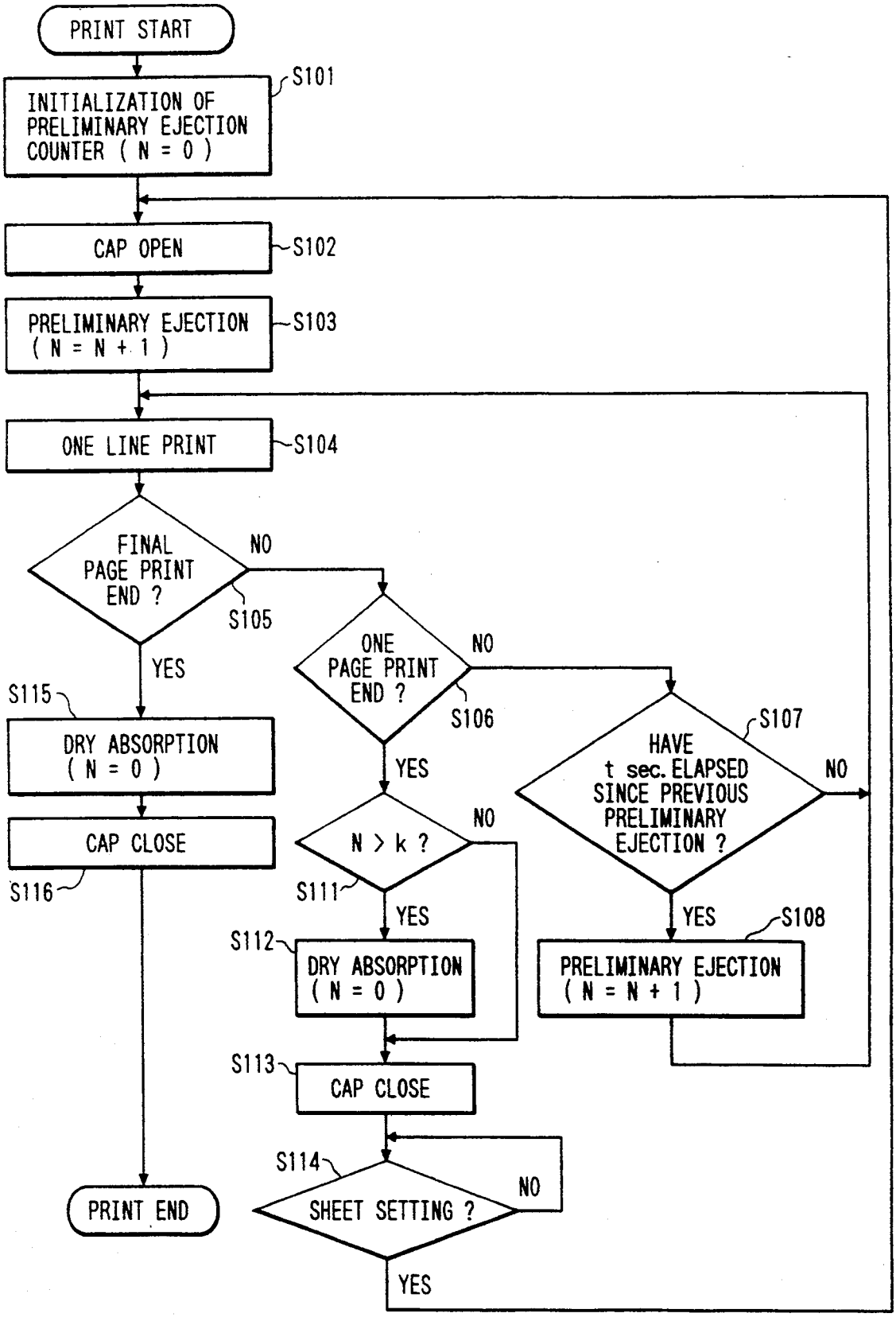

FIG. 24 shows a third control example of printer contorl unit 80. This example seeks to improve dry absorption at the end of printing of the last page in the second control example. Parts like those in FIG. 73 are designated by like reference symbols, and their description is not given.

Referring to the Figure, a check is done in step S105 as to whether printing of the last page has been ended through a check as to whether the pertaining control command is a print end command. If the printing is not of the last page, the routine goes to step S106. If printing of the last page has been ended, dry absorption is executed in step S115 irrespective of the number of times of preliminary ejection, the counter being initialized at this time. In subsequent step S116 cap 51 is closed to bring an end to the printing. If the routine goes back to step S106 and it is found in this step that printing of one page has been ended, upon detection of setting of sheet by pacer sensor 69 in step S114 the routine goes back to step S107 to start printing of the next page.

Figure 25:
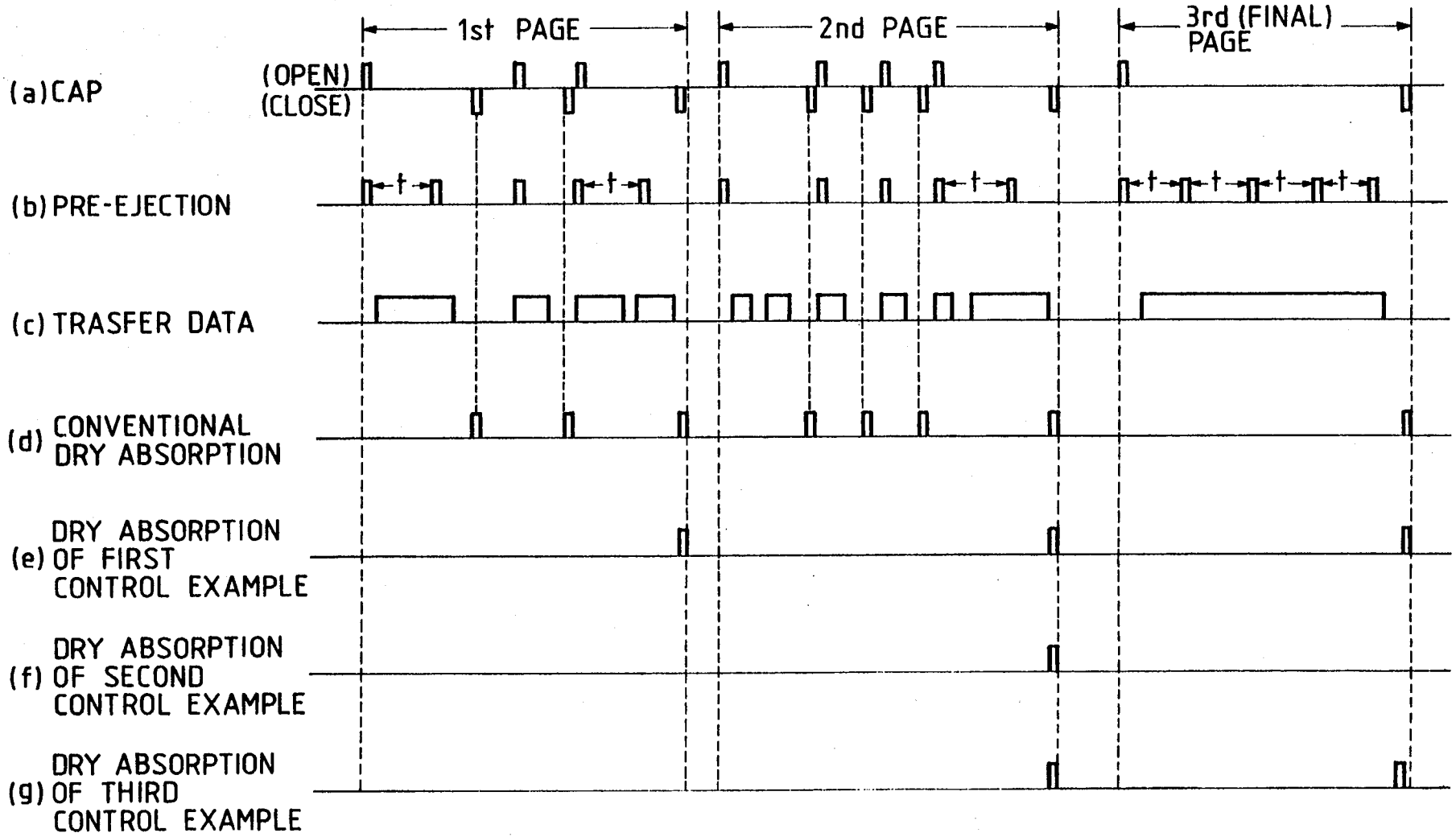
FIG. 25 is a timing chart showing operation in a second embodiment of the invention in the above construction.

Referring to (g) in FIG. 25 illustrating the operation of the third control example, the end of page printing of the 3-rd (i.e., last) page number N, i.e., number of times of preliminary ejection, is 5, and therefore at this time dry absorption is executed even if predetermined number K of 7 is not exceeded.

Thus, with the third control example, in addition to the effects of the second control example dry absorption is always executed at the end of printing of the last page, and this means that there is no possibility of ending the printing while ink remaining in the cap as a result of preliminary ejection is lever over. It is thus possible to prevent deterioration of ink absorbing capacity or reduction of ink absorbing power that might otherwise result from solidification of ink.

As an alternate constitution of the above embodiment, it is possible to arrange that control unit 10 directly controls printer unit 8 instead of the arrangement, in which control unit 10 transfers print data to printer control unit 80 which in turn controls head 9 and so forth for printing.

Further, the timings of execution of preliminary ejection are not limited to the instant of opening the cap and the instant after lapse of t seconds since the previous preliminary ejection as noted above.

With the second embodiment of the ink jet recording apparatus, ink received in the cap as a result of preliminary ejection is absorbed in dry absorption executed at the end of printing of each page, and thus it is possible to reduce the number of times of preliminary ejection during printing.

Further, ink received in the cap as a result of preliminary ejection is absorbed in dry absorption in case when the number of times of preliminary ejection is exceeding the predetermined number after the previously executed dry absorption at the end of printing of one page. This means that dry absorption is not executed unless the number of times of preliminary ejection is reaching the predetermined number after the previous dry absorption at the end of one page printing. It is thus possible to reduce not only the number of times of dry absorption executed during printing but also the number of times of dry absorption as a whole.

Figure 26:
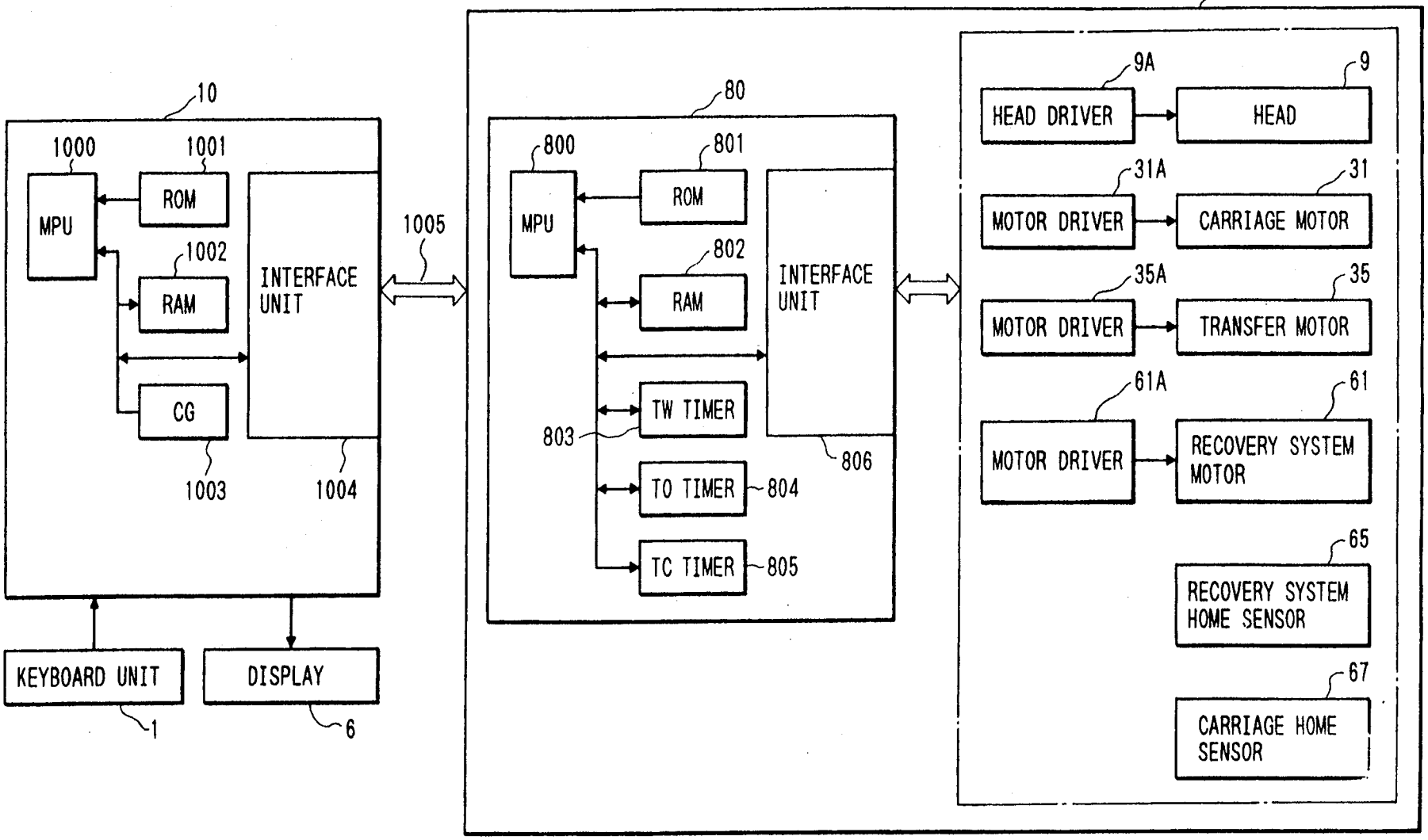
FIG. 26 is a block diagram showing a control system in a third embodiment of the invention in the recording apparatus shown in FIG. 2 and so forth.

Now, a third embodiment of the invention will be described. The mechanism construction of this embodiment is like that shown in FIGS. 1 to 11, and its description is not given. FIG. 26 shows control system of this embodiment. The system will be described in conjunction with only parts different from that in the first embodiment shown in FIG. 12.

Referring to FIG. 26, printer unit 8 includes printer control unit 80 for controlling head 9 and so forth to alleviate burden on control unit 10. Printer control unit 80 substantially the same construction as control unit 10 and includes MPU 800, ROM 801, RAM 802, TW, TO and T timers 803 to 805 for measuring time and interface unit 806.

Figure 27:
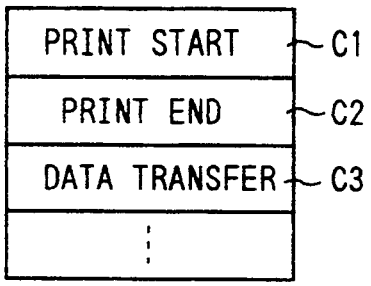
FIG. 27 is a command table showing commands used in the above control system.

FIG. 27 shows a table of control commands noted above, which are stored in ROM 801 of printer control unit 80. Designated at C1 is a print start command indicative of the start of printing, and at C2 is a print end command indicative of the end of printing. When data covering a plurality of pages is dealt with, this command indicates the end of printing of the last page. Designated at C3 is a data transfer command indicative of the transfer of print data corresponding in number to the number indicated by next transferred data.

Figure 28:
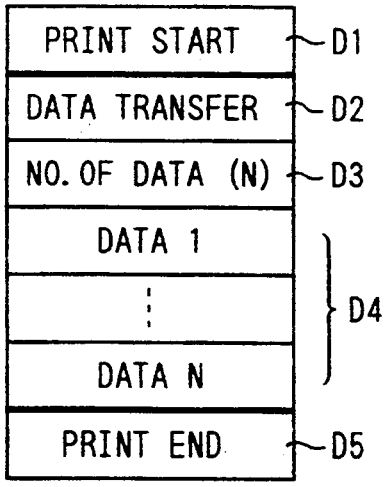
FIG. 28 is a format of data transferred in the above control system.

FIG. 28 shows a format of data transferred from control unit 10 to printer control unit 80. In this format, print start command D1 is transferred firstly, and then data transfer command D2, transferred data number (N) D3, N pieces of data D4 and print end command D5 are transferred in the mentioned order.

Now, a control routine of printer control unit 80 having received data transferred from control unit 10 shown in FIG. 26 for executing preliminary ejection and opening/closing of the cap will be described with reference to the flow chart and timing chart shown respectively in FIGS. 29 and 30.

Figures 29, 29A:
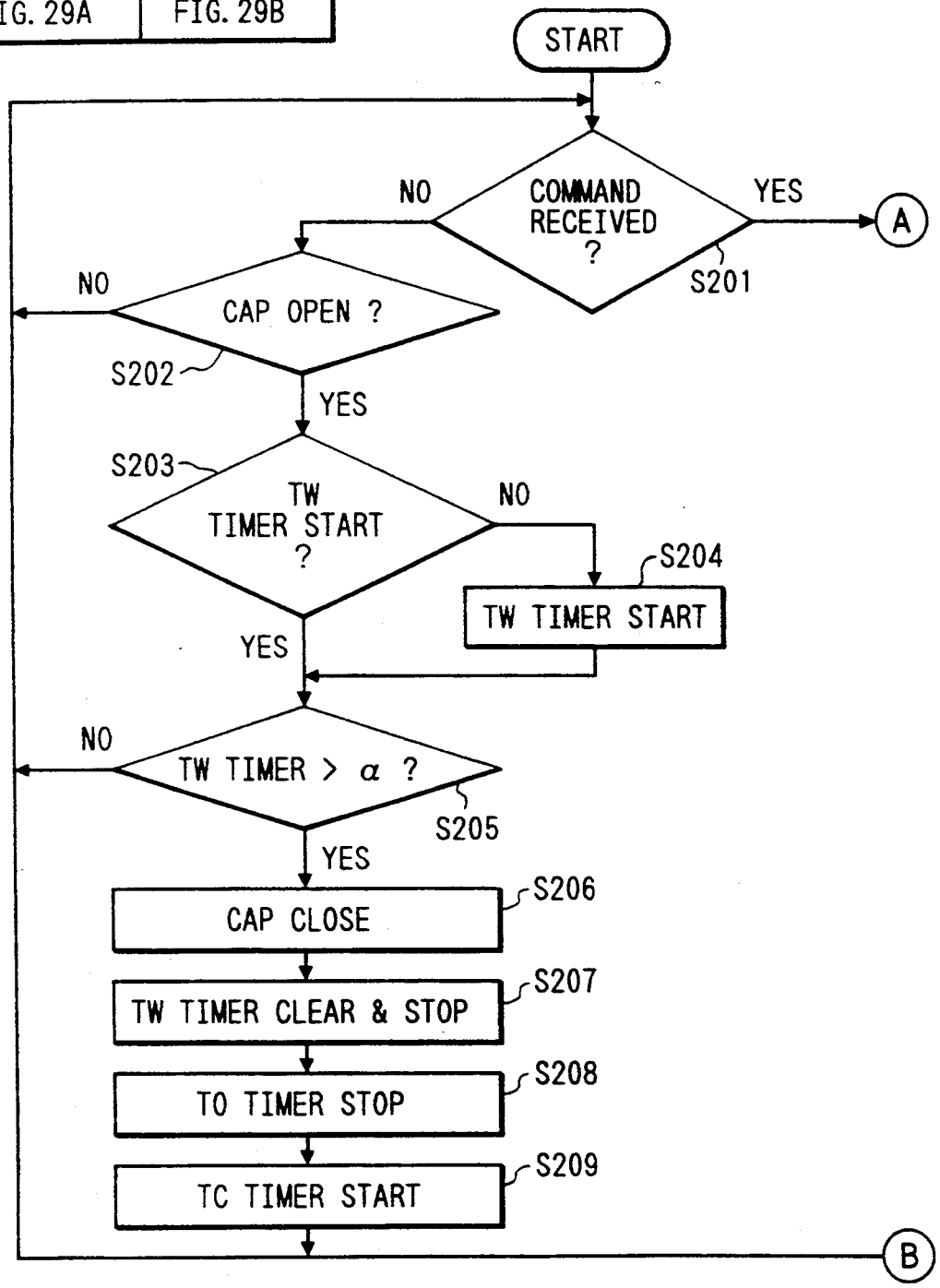
FIG. 29, 29A and 29B are a flow chart showing control routine in a third embodiment of the invention in the control system.
Figure 29B:
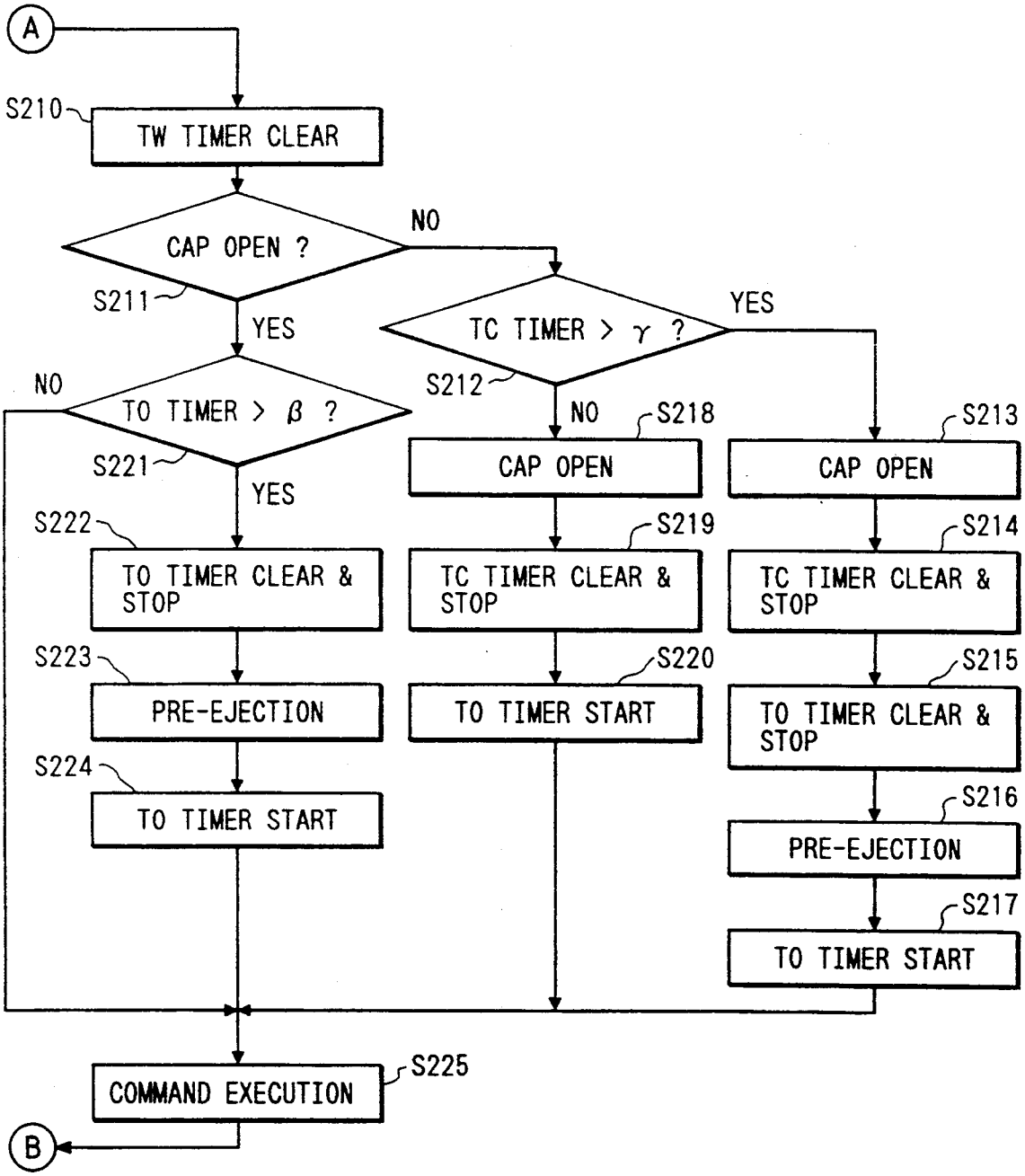

The control routine shown in FIG. 29 is started when a predetermined initializing operation subsequent to the closure of the power source of printer unit 8 is ended.

Firstly, NPU 800 executes a check in step S201 as to whether command data transferred from control unit 10 is received. If no command data is received, whether cap 51 is open or closed is checked in step S202. This check can be readily effected for MPU 800 itself is controlling the opening/closing of cap 51. If cap 51 is closed, the routine goes back to step S201. If cap 51 is open, a check is done in step S203 as to whether data wait time (hereinafter referred to as TW timer) 803 has been started. The TW timer is one, which counts time when there is no data transferred from control unit 10. It is used for obtaining a timing of closing cap 51. If TW timer 803 has not been started, it is started in step S204, and then the routine goes to step S205. IN step S205, a check is done as to whether a predetermined time of $\alpha$ seconds has been counted by TW timer 803.

The predetermined time of $\alpha$ seconds will now be described. If cap 51 of the recording head is held open, it will lead to a trouble in ink drop ejection. Accordingly, cap 51 may be closed if there is a pause in data transfer from control unit 10. However, if cap 51 is closed as soon as data transfer ceases, excess time is required in printing for opening or closing cap 51. For this reason, there is provided a time of $\alpha$ seconds which poses no problem in ink drop ejection, and cap 51 is closed if no data appears for more than $\alpha$ seconds.

If step S205 provides NO, the routine gooes back to step S201. On the other hand, if it is determined that $\alpha$ seconds has passed, cap 51 is closed in step S206, and in step S207 TW timer 803 which no longer needs to count time because cap 51 is closed is initialized, thus stopping the operation.

The operation of closing cap 51 is executed by driving revocery system motor 61 such that the position of cam unit 63 is changed from recording position (a) to home position (b). The operation of opening cap 51, which will be described later, is executed by driving recovery system motor 61 such that the position of cam unit 63 is changed from home position (b) to recording position (a).

In subsequent step S208, cap-"on" timer (hereinafter referred to as TO timer) 804 is tentatively stopped. TO timer 804 is one, which counts the time interval of the open state of cap 51 after the previous preliminary ejection. It is used for opening a timing of preliminary ejection. In step S209, cap close timer (hereinafter referred to as TC timer) 805 is started, and the routine goes back to step S207. TC timer 805 is one, which counts the time interval of the closed state of cap 51. It is used for a check as to whether preliminary discharge is to be done when cap 51 is opened.

If it is found in step S201 that transferred data has been received, TW timer 803 is cleared (i.e., initialized) in step S120. In subsequent step S211, a check is done as to whether cap 51 is open. If cap 51 is closed, a check is done in step S212 as to whether predetermined time of $\gamma$ seconds has been counted by TC timer 805. If NO is produced, the cap is opened in step S218, and in step S219 TC timer 805 is initialized and stopped. TO timer 804 is then started, and the routine then goes to step S225.

If it is found in step S212 that predetermined time of seconds has been passed, cap 51 is opened in step S213, and in sep S214 TC timer 805 is initialized and stopped. Then in step S215 TP timer 804 is initialized, and in step S216 preliminary ejection is executed. Then in step S217 TO timer 804 is started, and the routine goes back to step S225.

If it is found in step S221 that cap 51 is open, a check is done in step as to whether predetermined time of $\beta$ seconds has been counted by TO timer 804. If this time of $\beta$ seconds has not been passed, the routine goes to step S225. If the time has been passed, TO timer 804 is initialized in step S222, then the preliminary ejection is executed in step S223. TO timer 804 is then started in step S224, and then the routine goes to step S225. In step S225, a process pertaining to data received in step S201 (i.e., an operation concerning printing because the apparatus is a printer) is performed. The routine then goes back to step S201 to receive new transferred data.

Figure 30:
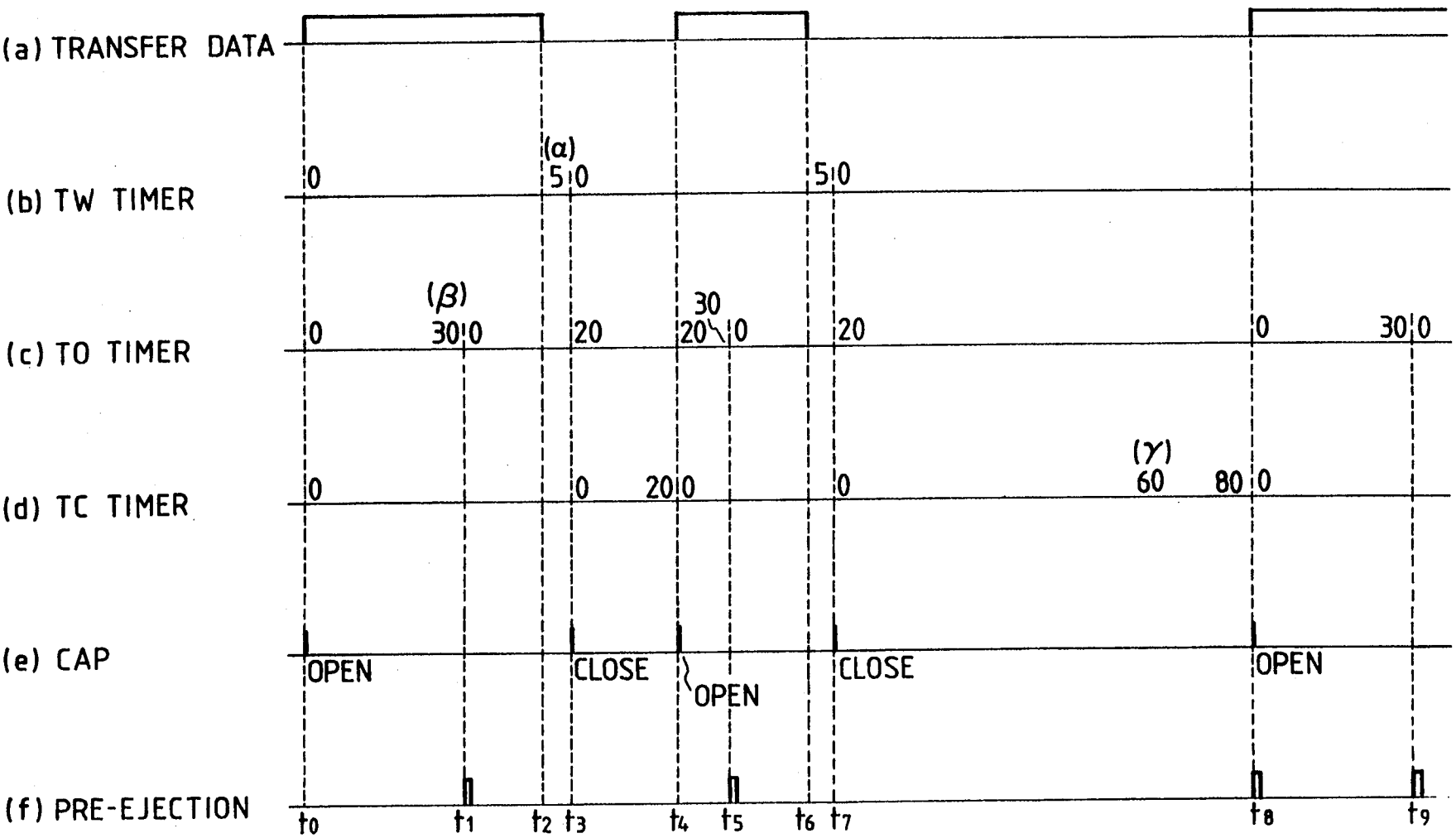
FIG. 30 is a timing chart showing operation of the third embodiment of the invention in the above system.

In the timing chart of FIG. 30 illustrating the operation of the above control routine, shown in (a) is a timing of data transfer from control iunit 10. Pause is produced in the data transfer for there is a case of requiring time for conversion into print data in control unit 10. Shown in (b) to (d) are time measurements by TW, TO and TC timers 803 to 805, respectively. Predetermined times $\alpha$, $\beta$ and $\gamma$ noted above are set to 5, 30 and 60 seconds, respectively. Shown in (e) is a timing of opening/closing of cap 51, and in (f) is a timing of preliminary ejection.

When transferred data is received at time tO, cap 51 is opened through steps S201, S210, S211, S212 and S218, and TO timer 804 is started in step S220. Subsequently, steps S201, S210, S211, S221 and S225 are repeatedly executed. However, if 30 seconds (i.e., $\beta$ seconds) has been counted by TO timer 804 at instant t1, steps S222 through S224 are executed to effect preliminary ejection and clear and start TO timer 804.

When transferred data vanishes at instant t2, steps S201, S202, S203 and S204 are executed to start TW timer 803. When 5 seconds (i.e., $\alpha$ seconds) is counted by TW timer 803 at instant t3, step S206 is executed to close cap 51. Further, steps S207 through S209 are executed to clear and stop TW timer 803, stop TO timer 804 at an intermediate instant corresponding to 20 seconds and start TC timer 805.

When transferred data appears at instant t, steps S201, S210, S211 and S212 are executed. Since at this time TC timer 85 is counting time less than $\gamma$ (i.e., 60) seconds, subsequent steps S218 through S220 are executed. Thus, cap 51 is opened, TC timer 805 is cleared and stopped, and TO timer 804 is started from an intermediate instant corresponding to 20 seconds during measurement.

When transferred data appears at instant t4 and this state is continued for 5 (i.e., $\alpha$) seconds, steps S211, S210, S211 and S212 are executed. Since at this time the count of timer 805 is less than $\gamma$ (i.e., 60), steps S218 through S220 are executed. Thus, cap 51 is opened, and TC timer 805 is cleared and started, and TO timer 804 is started from an instant when 20 seconds are passed in mesurement. Thus, at instant t5 after 10 seconds since the opening of cap 51 steps S221, S222, S223 and S224 are executed to effect preliminary ejection.

Transferred data vanishes at instant t6, and when this state is continued for 5 (i.e., $\alpha$) seconds, cap 51 is closed at instant t7. It is now assumed that no transferred data appears for long time until instant t8 when 80 seconds is counted by TC timer 805. In this case, steps S201, S210, S211 and S212 are executed. However, since the count of TC timer 805 is greater than $\gamma$ (i.e., 60) seconds, steps S213 to S217 are executed. Thus, cap 51 is opened, and TC timer 805 is cleared and stopped. Further, after TO timer has been cleared and stopped, preliminary ejection is executed, and TO timer 804 is started. As shown, when the closed period of cap 51 exceeds 60 (i.e., $\gamma$) seconds, preliminary ejection is executed when opening cap 51, and this it is possible to prevent defection ejection.

When TO timer 804 has counted 30 seconds at instant t9, steps S201, S210, S211 NS S221 through 225 are executed, and preliminary ejection thus is effected.

As has been shown, in this embodiment during the closed period of cap 51 TO timer 804 is stopped in step S208, and it is started in step S220 when cap 51 is opened. Thus, the number of times of preliminary ejection can be reduced without possibility of occurrence of defectively ejectable state of the recording head, and thus delay of recording time due to preliminary ejection can be reduced.

Further, the closed period of cap 51 is measured with TC timer 805 (step S9), and if the measured time exceeds predetermined period $\gamma$ of time, preliminary ejection is executed in step S218 when opening cap 51. Thus, it is possible to prevent occurrence of defectively ejectable state of the recording head even if the cap-"on" period of the recording head is prolonged during recording.

In the above embodiment control unit 10 transferred recording data to control unit 80 of printer unit 8, and printer control unit 80 in turn controlled head 9 and so forth for recording. However, it is possible to jet control unit 10 control printer 8 directly.

Further, with the third embodiment of ink jet recording apparatus the closed period of cap 51 is controlled such that the predetermined period noted above is not included. Therefore, the number of times of preliminary ejection can be reduced without possibility of occurrence of defectively ejectable state of the recording head.

Further, when the cap-"on" period exceeds the predetermined period, at the time of opening the cap preliminary ejection means is driven to effect preliminary ejection while initializing the predetermined period. Therefore, the possibility of occurrence of defectively electable state of the recording head can be prevented even if the cap-"on" period of the recording head is prolonged during recording.

We claim:

1. A recording apparatus for performing recording by ejecting an ink onto a recording medium for at least one page, the apparatus comprising:

an ink jet recording head having a face with an ink-ejecting discharging orifice, where said ink jet recording head is driven to eject the ink for a first time period and is not driven for a second time period;

a cap, openable and closable with respect to said recording head, for uncovering and covering said face;

cap drive means connected to said cap for opening and closing said cap, where said cap drive means opens said cap when the first time period begins and closes said cap when the second time period exceeds a predetermined time period $\alpha$;

preliminary ejection means for driving said recording head to eject the ink therefrom to remedy a defective ink ejection; and preliminary ejection drive means connected to said preliminary ejection means for driving said preliminary ejection means, where said preliminary ejection drive means drives said preliminary ejection means when a third time period after a previous ink ejection executed by said preliminary ejection means exceeds a predetermined time period $\beta$, wherein the predetermined time period $\beta$ does not include a time period during which said cap is closed.

2. The recording apparatus according to claim 1, wherein said cap drive means includes a timer for measuring the second time period.

3. The recording apparatus according to claim 1, wherein said preliminary ejection drive means includes a timer for measuring a time period during which said preliminary ejection means does not drive said recording head.

4. The recording apparatus according to claim 3, wherein said timer is stopped when said cap is closed.

5. The recording apparatus according to claim 1, wherein said cap includes an ink absorbing member.

6. The recording apparatus according to claim 1, wherein said recording head is mounted on a carriage which relatively scans said recording medium.

7. The recording apparatus according to claim 6, wherein said recording head is replaceably mounted on said carriage.

8. The recording apparatus according to claim 1, wherein said recording head includes a plurality of said discharging orifices and heat energy generation means corresponding to said discharging orifices for causing a thermal change of a state of the ink to thereby eject the ink from said discharging orifices as flying ink drops.

9. The recording apparatus according to claim 1, further comprising interface means for inputting a recording signal to be supplied to said recording head.

10. The recording apparatus according to claim 9, wherein said interface means is connected to a document processing function unit and inputs document data as said recording signal.

11. The recording apparatus according to claim 9, wherein said interface means is connected to a reader function section and inputs reading data as said recording signal.

12. A recording apparatus for performing recording by ejecting an ink onto a recording medium for at least one page, the apparatus comprising:

an ink jet recording head having a face with an ink-ejecting discharging orifice., where said ink jet recording head is driven to eject the ink for a first time period and is not driven for a second time period;

a cap, openable and closable with respect to said recording head, for covering and uncovering said face;

cap drive means connected to said cap for opening and closing said cap, where said cap drive means opens said cap when the first time period begins and closes said cap when the second time period exceeds a predetermined time period $\alpha$;

preliminary ejection means for driving said recording head to eject the ink therefrom to remedy a defective ink ejection;

first preliminary ejection drive means coupled to said preliminary ejection means for driving said preliminary ejection means, where said first preliminary ejection drive means drives said preliminary ejection means when a third time period after a previous ink ejection executed by said preliminary ejection means exceeds a predetermined time period $\beta$; and second preliminary ejection drive means coupled to said preliminary ejection means for driving said preliminary ejection means, where said second preliminary ejection drive means drives said preliminary ejection means when said cap is opened after having been closed for a predetermined time period $\gamma$, and where timing of the third time period is begun when said cap is opened.

13. The recording apparatus according to claim 12, wherein the predetermined time period $\beta$ does not include a time period during which said cap is closed.

14. The recording apparatus according to claim 12, wherein said cap drive means includes a timer for measuring the second time period.

15. The recording apparatus according to claim 12, wherein said first preliminary ejection drive means includes a timer for measuring a time period during which said preliminary ejection means does not drive said recording head.

16. The recording apparatus according to claim 12, wherein said second preliminary ejection drive means includes a timer for measuring a time period during which said cap is closed.

17. The recording apparatus according to claim 13, wherein said timer is stopped when said cap is closed.

18. The recording apparatus according to claim 12, wherein said cap includes an ink absorbing member.

19. The recording apparatus according to claim 12, wherein said recording head is mounted on a carriage which relatively scans said recording medium.

20. The recording apparatus according to claim 19, wherein said recording head is replaceably mounted on said carriage.

21. The recording apparatus according to claim 12, wherein said recording head includes a plurality of said discharging orifices and heat energy generation means corresponding to said discharging orifices for causing a thermal change of a state of the ink to thereby eject the ink from said discharging orifices as flying ink drops.

22. The recording apparatus according to claim 12, further comprising interface means for inputting a recording signal to be supplied to said recording head.

23. The recording apparatus according to claim 22, wherein said interface means is connected to a document processing function unit and inputs document data as said recording signal.

24. The recording apparatus according to claim 22, wherein said interface means is connected to a reader function section and inputs reading data as said recording signal.

25. A method of ink jet recording using a recording head which is driven to eject an ink and a cap for covering said recording head, the method comprising the steps of:

opening said cap prior to a time period during which said recording head is driven;

counting a non-driving period during which said recording head is not driven;

closing said cap when the non-driving period exceeds a predetermined time period $\alpha$;

counting an elapsed time since a previous preliminary ejection of the ink from said recording head has been carried out to remedy a defective ink ejection, wherein the elapsed time is not counted when said cap is closed; and performing a preliminary ejection when the elapsed time exceeds a predetermined time period $\beta$.

26. A method according to claim 25, wherein said recording head includes a plurality of ink discharging orifices and heat energy generating means corresponding to said discharging orifices for causing a thermal change of a state of the ink to thereby eject the ink from said discharging orifices as flying ink drops.

27. A method of ink jet recording using a recording head which is driven to eject an ink and a cap for covering said recording head, the method comprising the steps of:

opening said cap prior to a time period during which said recording head is driven;

counting a non-driving period during which said recording head is not driven;

closing said cap when the non-driving period exceeds a predetermined time period $\alpha$;

counting an elapsed time since a previous preliminary ejection of the ink from said recording head has been carried out to remedy a defective ink ejection;

performing a preliminary ejection when the elapsed time exceeds a predetermined time period $\beta$; and counting a time interval during which said cap is closed, wherein the preliminary ejection is performed when said cap is opened after the time interval exceeds a predetermined time period $\gamma$, and counting of the elapsed time since a previous preliminary ejection is initiated when said cap is opened.

28. A method according to claim 27, wherein said recording head includes a plurality of ink discharging orifices and heat energy generating means corresponding to said discharging orifices for causing a thermal change of a state of the ink to thereby eject the ink from said discharging orifices as flying ink droplets.

* * * * *

UNITED STATES PATENT AND TRADEMARK OFFICE

CERTIFICATE OF CORRECTION

PATENT NO. : 5,406,317

DATED : April 11, 1995

INVENTOR(S) : YOSHIYUKI SHIMAMURA, ET AL.

It is certified that error appears in the above-identified patent and that said Letters Patent is hereby corrected as shown below:

COLUMN 6

Line 20, "brought" should read --be brought--.
Line 25, "jet" should read --jetted--.

COLUMN 9

Line 5, "rop-"should read --ro- --.
Line 15, "time" should read --times--.
Line 48, "acting" should read --applying--.

COLUMN 11

Line 58, "1001" should read --1002--.

COLUMN 12

Line 63, "receiving" should be deleted.

COLUMN 13

Line 12, "since" should be deleted.
Line 36, "Insubsequent" should read --In subsequent--.

COLUMN 15

Line 15, "19 to 71" should read --19 to 21--.
Line 18, "absorption" should read --absorptions--.
Line 19, "increased compared to is" should read --is increased compared to--.

UNITED STATES PATENT AND TRADEMARK OFFICE

CERTIFICATE OF CORRECTION

PATENT NO. : 5,406,317

DATED : April 11, 1995

INVENTOR(S) : YOSHIYUKI SHIMAMURA, ET AL.

It is certified that error appears in the above-identified patent and that said Letters Patent is hereby corrected as shown below:

COLUMN 16

Line 2, "is" should be deleted.
Line 3, "(n≦n1)" should read --(n2≦n1)--.
Line 52, "by-driving" should read --by driving--.
Line 66, "driving 31." should read --driving carriage motor 31.--.

COLUMN 17

Line 5, "increased" should read --increase--.
Line 13, "systemmotor" should read --system motor--.
Line 15, "(b) FIGS." should read --(b) in FIGS.--.
Line 50, "solidifition" should read --solidification-- and "absorking" should read --absorbing--.

COLUMN 18

Line 12, "be" should read --been-- and "shcek" should read --check--.
Line 26, "pring" should read --bring--.
Line 32, "(B), (c) and (F) in FIG. 15." should read --(b), (c) and (f) in FIG. 25.--.
Line 56, "dap." should read --cap.--.
Line 60, "contorl" should read --control--.

COLUMN 19

Line 22, "lever" should read --left--.
Line 65, "80 substantially" should read --80 has substantially--.

UNITED STATES PATENT AND TRADEMARK OFFICE

CERTIFICATE OF CORRECTION

PATENT NO. : 5,406,317

DATED : April 11, 1995

INVENTOR(S) : YOSHIYUKI SHIMAMURA, ET AL.

It is certified that error appears in the above-identified patent and that said Letters Patent is hereby corrected as shown below:

COLUMN 20

Line 39, "IN" should read --In--.
Line 59, "revocery" should read --recovery--.

COLUMN 21

Line 40, "iunit" should read --unit--.

COLUMN 22

Line 11, "mesurement." should read --measurement.--.
Line 30, "NS" should read --and--.
Line 51, "jet" should read --let--.
Line 65, "electable" should read --ejectable--.

Signed and Sealed this

Fifteenth Day of August, 1995

Bruce Lehman

*Attest:*

BRUCE LEHMAN

*Attesting Officer*

*Commissioner of Patents and Trademarks*